US011727871B2

(12) United States Patent
Pyun et al.

(10) Patent No.: US 11,727,871 B2
(45) Date of Patent: Aug. 15, 2023

(54) DISPLAY DEVICE AND DRIVING METHOD THEREOF

(71) Applicant: Samsung Display Co., Ltd., Yongin-Si (KR)

(72) Inventors: Kihyun Pyun, Gwangmyeong-si (KR); Minyoung Park, Busan (KR); Eunjin Choi, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/361,840

(22) Filed: Jun. 29, 2021

(65) Prior Publication Data

US 2022/0148501 A1 May 12, 2022

(30) Foreign Application Priority Data

Nov. 9, 2020 (KR) ..... 10-2020-0148898

(51) Int. Cl.
*G09G 3/3233* (2016.01)

(52) U.S. Cl.
CPC ..... *G09G 3/3233* (2013.01); *G09G 2310/027* (2013.01); *G09G 2320/0233* (2013.01); *G09G 2320/0666* (2013.01)

(58) Field of Classification Search
CPC ..... G09G 3/3233; G09G 2310/027; G09G 2320/0233; G09G 2320/0666
See application file for complete search history.

(56) References Cited

U.S. PATENT DOCUMENTS

| | | | | |
|---|---|---|---|---|
| 9,269,301 | B2 | 2/2016 | Lee et al. | |
| 9,368,060 | B2 | 6/2016 | Chae et al. | |
| 9,870,733 | B2 | 1/2018 | Chun et al. | |
| 9,916,790 | B2 * | 3/2018 | Kim | G09G 3/3208 |
| 10,297,191 | B2 | 5/2019 | Hoffman | |
| 2011/0012819 | A1 * | 1/2011 | Ryu | G09G 3/3291 345/82 |
| 2011/0115832 | A1 * | 5/2011 | Lee | G09G 3/3233 345/212 |
| 2011/0316893 | A1 * | 12/2011 | Lee | G09G 3/3208 345/77 |
| 2017/0162098 | A1 * | 6/2017 | Cheon | G09G 3/2003 |
| 2017/0221413 | A1 * | 8/2017 | Hoffman | G09G 3/3426 |
| 2020/0111455 | A1 | 4/2020 | Lee et al. | |

FOREIGN PATENT DOCUMENTS

| | | | |
|---|---|---|---|
| KR | 1020160049073 | A | 5/2016 |
| KR | 1020170050748 | A | 5/2017 |
| KR | 1020170091517 | A | 8/2017 |
| KR | 102048075 | B1 | 11/2019 |
| KR | 102061554 | B1 | 1/2020 |
| KR | 1020200039082 | A | 4/2020 |

* cited by examiner

*Primary Examiner* — Jeff Piziali
(74) *Attorney, Agent, or Firm* — Cantor Colburn LLP

(57) ABSTRACT

A display device includes a display panel which displays an image, a current compensator and a panel driver. The current compensator calculates a load based on input image data and compensates the input image data to output compensation image data having a target current corresponding to the load. The panel driver drives the display panel based on the compensation image data. The current compensator calculates the load for the input image data based on a combination of load weights calculated by different variables.

20 Claims, 18 Drawing Sheets

DISPLAY DEVICE AND DRIVING METHOD THEREOF

This application claims priority to Korean Patent Application No. 10-2020-0148898, filed on Nov. 9, 2020, and all the benefits accruing therefrom under 35 U.S.C. § 119, the content of which in its entirety is herein incorporated by reference.

BACKGROUND

The present disclosure herein relates to a display device and a driving method thereof, and more particularly, to a display device capable of accurate luminance compensation and a driving method of the display device.

Among display devices, an organic light emitting display device displays an image using an organic light emitting diode that generates light by recombination of electrons and holes. Such an organic light emitting display device has an advantage of having a fast response speed and being driven with low power consumption.

The organic light emitting display device includes pixels connected to data lines and scan lines. Pixels generally include an organic light emitting diode and a circuit unit for controlling an amount of current flowing through the organic light emitting diode. The circuit unit controls the amount of current flowing from a first driving voltage to a second driving voltage through an organic light emitting diode in response to a data signal. In this case, light having a predetermined luminance is generated in response to the amount of current flowing through the organic light emitting diode.

The organic light emitting diode serves as a load to drive the display panel, and the load may increase as the number of driven organic light emitting diodes increases. Depending on the load, the amount of current flowing through the organic light emitting diode may vary, which may deteriorate the overall luminance characteristics of the display device.

SUMMARY

The present disclosure provides a display device capable of accurately performing luminance compensation in consideration of differences in efficiency of various variables that affect a load and a method of driving the display device.

An embodiment of the inventive concept provides a display device including a display panel which displays an image, a current compensator and a panel driver. The current compensator calculates a load based on input image data and compensates the input image data to output compensation image data having a target current corresponding to the load. The panel driver drives the display panel based on the compensation image data. The current compensator calculates the load for the input image data based on a combination of load weights calculated by different variables.

In an embodiment of the inventive concept, a driving method of a display device includes: calculating a load for input image data based on a combination of load weights calculated by different variables; compensating the input image data to have a target current corresponding to the load and outputting compensated image data; generating a driving signal for driving a display panel based on the compensation image data; and displaying an image on the display panel based on the driving signal.

BRIEF DESCRIPTION OF THE FIGURES

The accompanying drawings are included to provide a further understanding of the inventive concept, and are incorporated in and constitute a part of this specification. The drawings illustrate embodiments of the inventive concept and, together with the description, serve to explain principles of the inventive concept. In the drawings.

DETAILED DESCRIPTION

Figure 1:
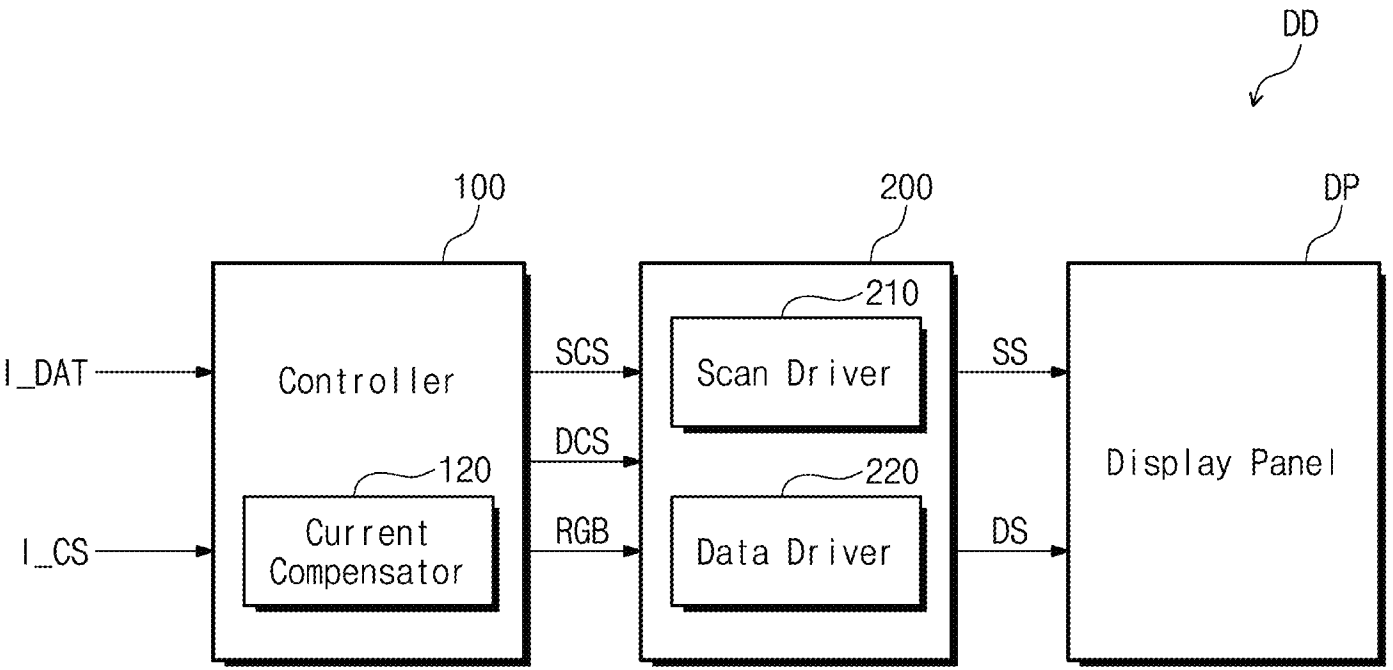
FIG. 1 is a block diagram of a display device according to an embodiment of the inventive concept.

In this specification, when an element (or region, layer, part, etc.) is referred to as being "on", "connected to", or "coupled to" another element, it means that it may be directly placed on/connected to/coupled to other components, or a third component may be arranged between them.

Like reference numerals refer to like elements. Additionally, in the drawings, the thicknesses, proportions, and dimensions of components are exaggerated for effective description.

The terminology used herein is for the purpose of describing particular embodiments only and is not intended to be limiting. As used herein, the singular forms "a," "an," and "the" are intended to include the plural forms, including "at least one," unless the content clearly indicates otherwise. "At least one" is not to be construed as limiting "a" or "an." "Or" means "and/or." "And/or" includes all of one or more combinations defined by related components.

It will be understood that the terms "first" and "second" are used herein to describe various components but these components should not be limited by these terms. The above terms are used only to distinguish one component from another. For example, a first component may be referred to as a second component and vice versa without departing from the scope of the inventive concept. The terms of a singular form may include plural forms unless otherwise specified.

In addition, terms such as "below", "the lower side", "on", and "the upper side" are used to describe a relationship of configurations shown in the drawing. The terms are described as a relative concept based on a direction shown in the drawing.

Unless otherwise defined, all terms (including technical and scientific terms) used herein have the same meaning as commonly understood by one of ordinary skill in the art to which this inventive concept belongs. In addition, terms defined in a commonly used dictionary should be interpreted as having a meaning consistent with the meaning in the context of the related technology, and unless interpreted in an ideal or overly formal sense, the terms are explicitly defined herein.

In various embodiments of the inventive concept, the term "include," "comprise," "including," or "comprising," specifies a property, a region, a fixed number, a step, a process, an element and/or a component but does not exclude other properties, regions, fixed numbers, steps, processes, elements and/or components.

Hereinafter, embodiments of the inventive concept will be described with reference to the drawings.

Figure 2:
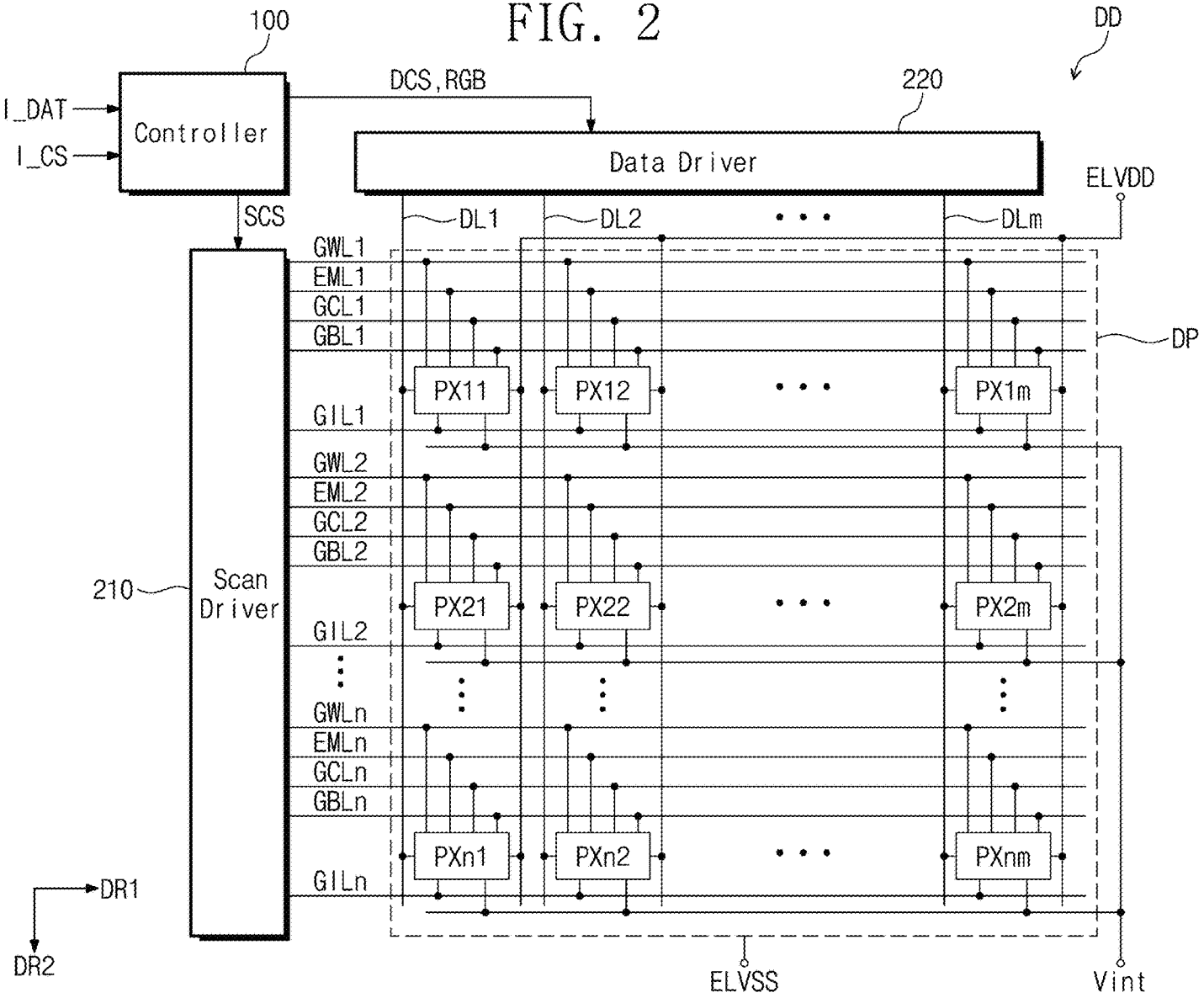
FIG. 2 is a block diagram illustrating the display panel shown in FIG. 1.

FIG. 1 is a block diagram of a display device according to an embodiment of the inventive concept, and FIG. 2 is a block diagram specifically showing the display panel shown in FIG. 1.

Referring to FIGS. 1 and 2, a display device DD according to an embodiment of the inventive concept is a device configured to display an image. The display device DD receives input image data I_DAT and an input control signal I_CS from the outside.

The display device DD includes a display panel DP, a controller 100 and a panel driver 200. The display device DD may be a device that is activated according to an electrical signal. The display device DD may include various embodiments. For example, the display device DD may be a display device used in a tablet, notebook computer, computer, television, or smart phone.

The controller 100 receives input image data I_DAT and an input control signal I_CS from the outside. The input image data I_DAT may include red image data, green image data, and blue image data. The controller 100 may convert the data format of the input image data I_DAT. The input control signal I_CS may include a vertical synchronization signal, a data enable signal, a master clock signal, and the like, but is not limited thereto. The controller 100 may generate a driving control signal based on the input control signal I_CS.

The display device DD may include a current compensator 120. As an example of the inventive concept, the current compensator 120 may be included in the controller 100. However, the location of the current compensator 120 according to the invention is not limited thereto. For example, the current compensator 120 may be provided as a configuration separated from the controller 100 in another embodiment. The current compensator 120 extracts the load of the input image data I_DAT, compensates the input image data I_DAT to have a target current corresponding to the load, and generate compensation image data RGB. The compensation image data RGB generated from the current compensator 120 may be provided to the panel driver 200.

The panel driver 200 may include a scan driver 210 and a data driver 220. The driving control signal generated by the controller 100 may include a scan control signal SCS for controlling driving of the scan driver 210 and a data control signal DCS for controlling driving of the data driver 220.

The scan driver 210 receives the scan control signal SCS from the controller 100. The scan control signal SCS may include a start signal for starting the operation of the scan driver 210 and a vertical clock signal. The scan driver 210 generates a plurality of scan signals SS, and sequentially outputs the plurality of scan signals SS to scan lines (to be described later). In addition, the scan driver 210 may generate a plurality of emission control signals in response to the scan control signal SCS, and may output the plurality of emission control signals to a plurality of emission control lines EML1 to EMLn.

In an embodiment of the inventive concept, the scan driver 210 may include an initialization scan driver, a compensation scan driver, a write scan driver, and a black scan driver. The initialization scan driver outputs initialization scan signals to initialization scan lines GIL1 to GILn of the display panel DP, and the compensation scan driver outputs the compensation scan signals to compensation scan lines GCL1 to GCLn of the display panel DP. The initialization scan driver and the compensation scan driver may be configured as independent circuits or may be integrated into one circuit. In the case that the initialization scan driver and the compensation scan driver are integrated into one circuit, the initialization scan signals may be defined as previous scan signals, and the compensation scan signals may be defined as current scan signals.

The write scan driver outputs write scan signals to write scan lines GWL1 to GWLn of the display panel DP, and the black scan driver outputs black scan signals to black scan lines GBL1 to GBLn of the display panel DP. Each of the write scan driver and the black scan driver may be configured as independent circuits or may be integrated into one circuit. In the case that the write scan driver and the black scan driver are integrated into one circuit, the write scan signals may be defined as current scan signals, and the black scan signals may be defined as next scan signals.

In addition, in FIG. 2, the scan driver 210 is electrically connected to the plurality of emission control lines EML1 to EMLn. Although FIG. 2 illustrates that a plurality of scan signals SS and a plurality of emission control signals are outputted from one scan driver 210, the inventive concept is not limited thereto. Optionally, the panel driver 200 may further include a light emitting driver that outputs a plurality of emission control signals to the plurality of emission control lines EML1 to EMLn. In this case, the light emitting driver and the plurality of emission control lines EML1 to EMLn may be electrically separated from the scan driver 210.

In another embodiment, the scan driver 210 may be embedded in the display panel DP. That is, the scan driver 210 may be formed on the display panel DP through a thin film process of forming the pixels PX11 to PXnm of the display panel DP.

The data driver 220 receives the data control signal DCS and the compensation image data RGB from the controller 100. The data driver 220 converts the compensation image data RGB into data signals DS, and outputs the data signals DS to a plurality of data lines DL1 to DLm (to be described later). The data signals DS may be analog voltages corresponding to grayscale values of the compensation image data RGB.

The display device DD further includes a voltage generator (not shown) for generating voltages to operate the display device DD. In this embodiment, the voltage generator may generate a first power voltage ELVDD, a second power voltage ELVSS, and an initialization voltage Vint.

The display panel DP may be a component that substantially generates an image. As an example of the inventive concept, the display panel DP may be an organic light emitting display panel. The display panel DP includes scan lines, emission control lines EML1 to EMLn, data lines DL1 to DLm, and pixels PX11 to PXnm. The scan lines and the emission control lines EML1 to EMLn extend in the first direction DR1 and are arranged to be spaced apart from each other in the second direction DR2. The data lines DL1 to DLm extend in the second direction DR2 and are arranged to be spaced apart from each other in the first direction DR1. As an example of the inventive concept, the scan lines include the initialization scan lines GIL1 to GILn, compensation scan lines GCL1 to GCLn, write scan lines GWL1 to GWLn, and black scan lines GBL1 to GBLn.

Each of the pixels PX11 to PXnm is connected to a corresponding data line, a corresponding scan line, and a corresponding emission control line. For example, among the pixels PX11 to PXnm, the first pixel PX11 is connected to a first data line DL1, a first emission control line EML1, a first initialization scan line GIL1, a first compensation scan line GCL1, a first write scan line GWL1, and a first black scan line GBL1. The last pixel PXnm among the pixels PX11 to PXnm is connected to an m-th data line DLm, an n-th emission control line EMLn, an n-th initialization scan line GILn, an n-th compensation scan line GCLn, an n-th write scan line GWLn, and an n-th black scan line GBLn. That is, as an example of the inventive concept, each of the plurality of pixels PX11 to PXnm may be electrically connected to four types of scan lines. However, the types of scan lines connected to each of the plurality of pixels PX11 to PXnm according to the invention are not limited thereto. That is, two or three types of scan lines may be connected to each of the plurality of pixels PX11 to PXnm in another embodiment.

The first power voltage ELVDD, the second power voltage ELVSS, and the initialization voltage Vint may be supplied to the display panel DP. Each of the pixels PX may receive the first power voltage ELVDD, the second power voltage ELVSS, and the initialization voltage Vint.

Each of the plurality of pixels PX11 to PXnm includes a light emitting element and a pixel circuit unit that controls light emission of the light emitting element. As an example of the inventive concept, the light emitting element may be an organic light emitting diode.

Figure 3:
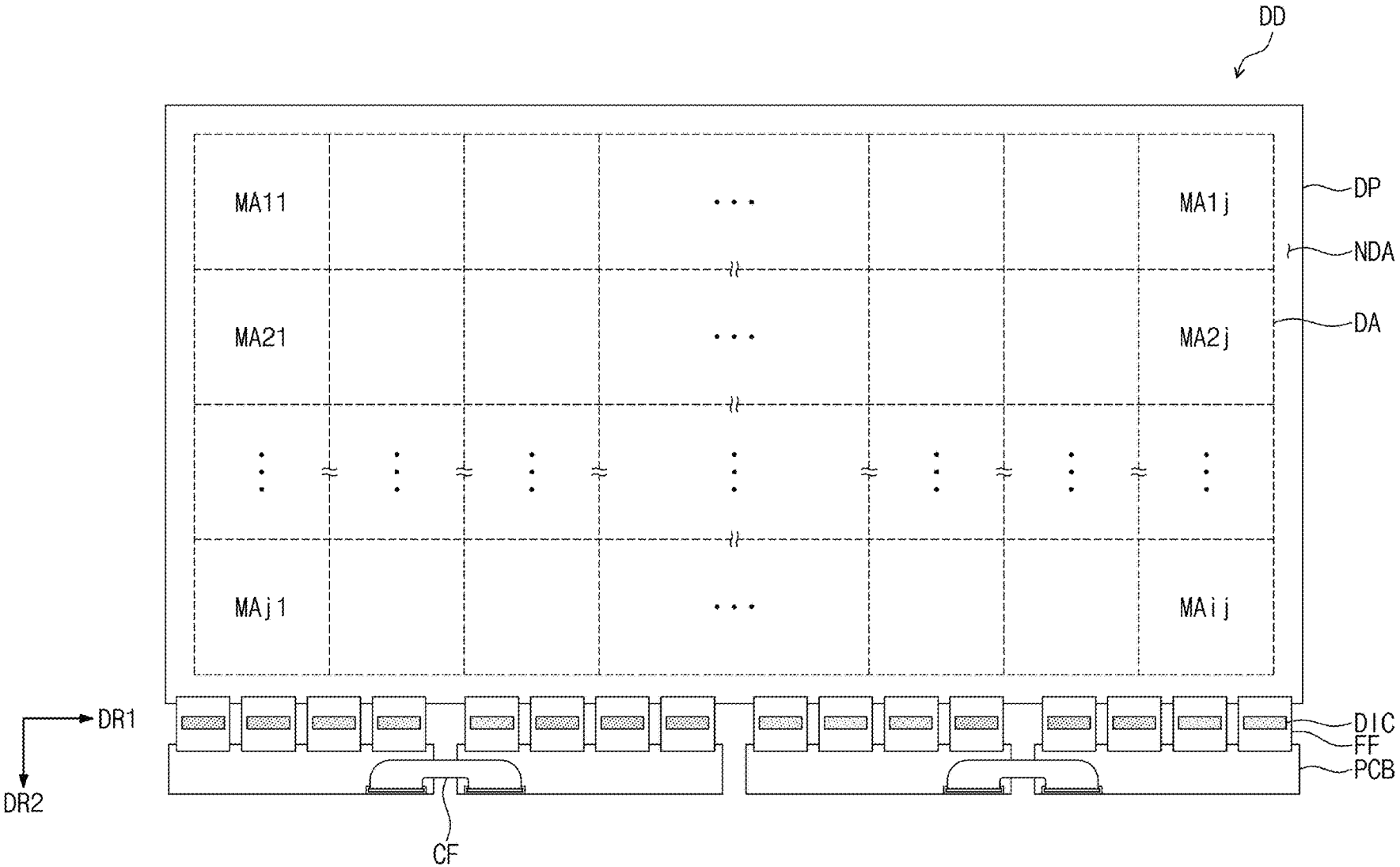
FIG. 3 is a plan view of a display device according to an embodiment of the inventive concept.

FIG. 3 is a plan view of a display device according to an embodiment of the inventive concept.

Referring to FIG. 3, the display panel DP includes a display area DA for displaying an image and a non-display area NDA adjacent to the display area DA. The display area DA is an area in which the image is substantially displayed, and the non-display area NDA is a bezel area in which the image is not displayed. FIG. 3 illustrates a structure in which the non-display area NDA is disposed to surround the display area DA, but the inventive concept is not limited thereto. The non-display area NDA may be disposed only on at least one side of the display area DA in another embodiment.

The display area DA may include a plurality of measurement areas MA11 to MAij. The plurality of measurement areas MA11 to MAij may be defined in a form of a matrix in the first and second directions DR1 and DR2. As an example of the inventive concept, the display area DA may include ixj measurement areas MA11 to MAij. Here, i and j may be integers of 2 or more. However, the shape of the plurality of measurement areas MA11 to MAij is not limited thereto. For example, the display area DA may include only a plurality of measurement areas divided in the first direction DR1 or may include only a plurality of measurement areas divided in the second direction DR2 in another embodiment.

The arrangement shape and the number of the plurality of measurement areas MA11 to MAij may be changed according to panel characteristics such as the size and resolution of the display panel DP.

The plurality of measurement areas MA11 to MAij are divided areas for measuring current in each area, and the current compensator 120 (see FIG. 1) operates the display panel DP for each measurement area to measure the current in the corresponding measurement area.

The current compensator 120 will be described in detail with reference to the accompanying drawings.

The display device DD may further include a plurality of flexible films FF connected to the display panel DP. A driving chip DIC may be mounted on each of the flexible films FF. As an example of the inventive concept, the data driver 220 (see FIGS. 1 and 2) may be composed of a plurality of driving chips DIC, and the plurality of driving chips DIC may be mounted on the plurality of flexible films FF, respectively.

The display device DD may further include at least one circuit board PCB coupled to the plurality of flexible films FF. As an example of the inventive concept, four circuit boards PCB are provided in the display device DD in FIG. 3, but the number of circuit boards PCB according to the invention is not limited thereto. Two adjacent circuit boards among the circuit boards PCB may be electrically connected to each other by a connection film CF. Also, at least one of the circuit boards PCB may be electrically connected to the main board. The controller 100 (refer to FIGS. 1 and 2) and a voltage generator may be disposed on at least one of the circuit boards PCB.

Figure 4:
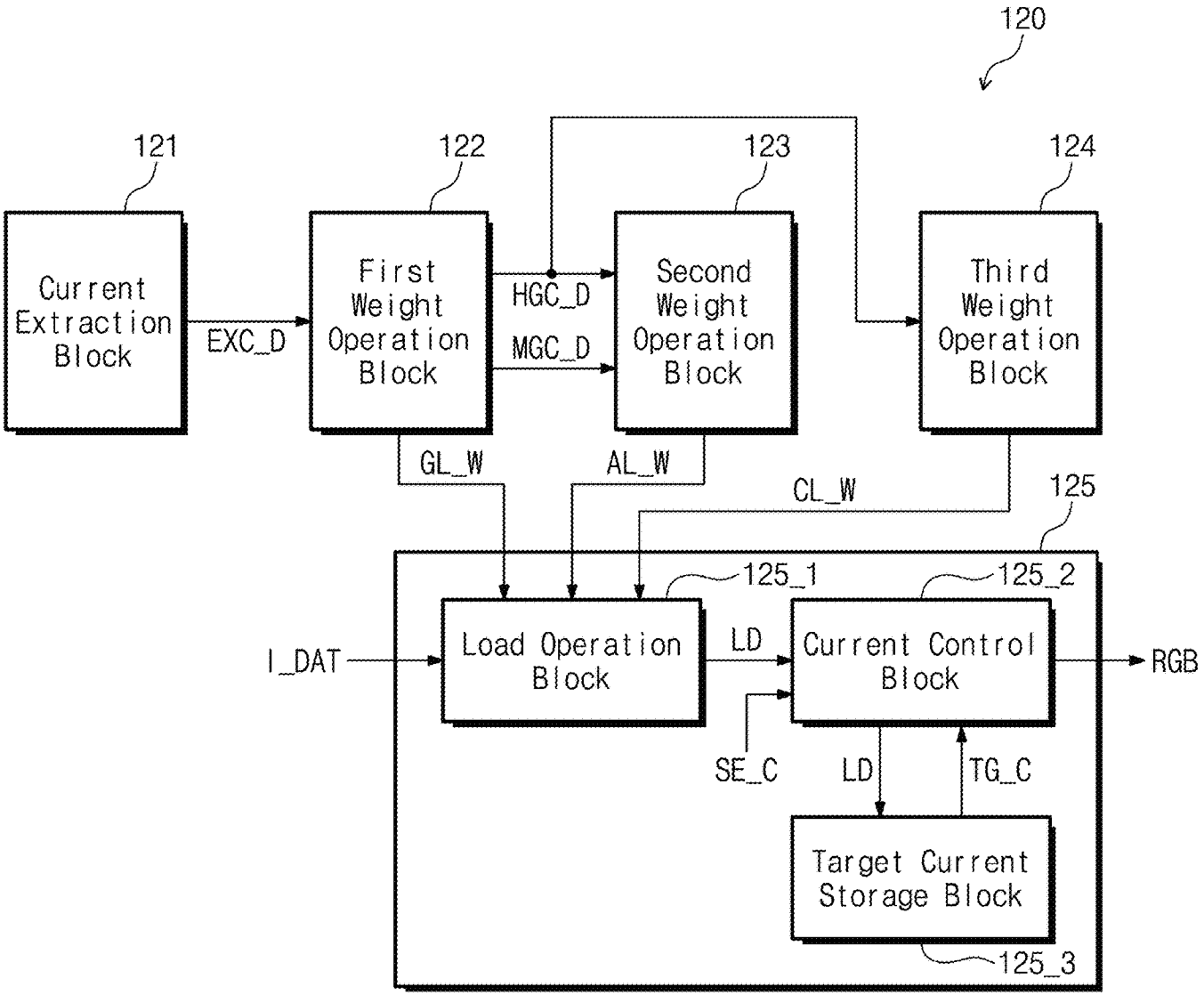
FIG. 4 is a block diagram of a current compensator according to an embodiment of the inventive concept.
Figure 5:
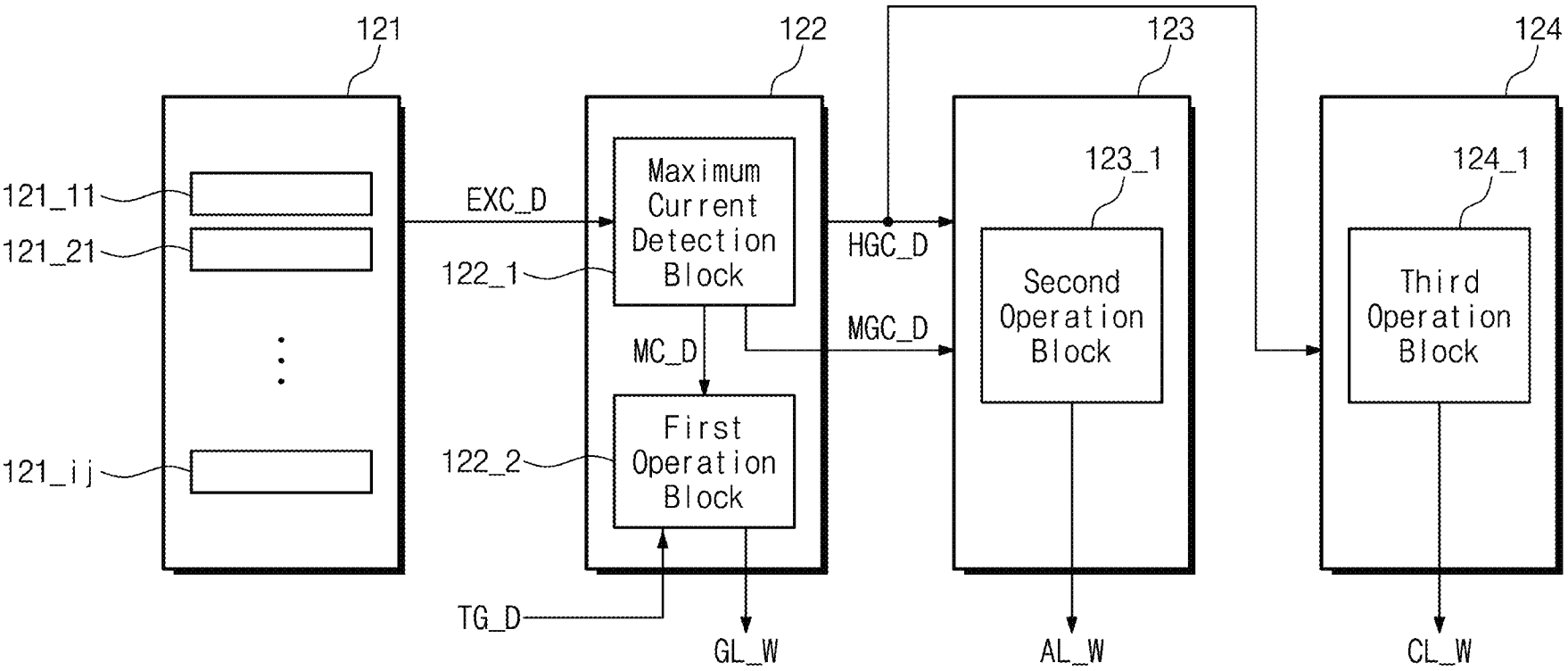
FIG. 5 is a block diagram showing the internal configuration of the current extraction block and first to third weight operation blocks shown in FIG. 4.
Figure 6:
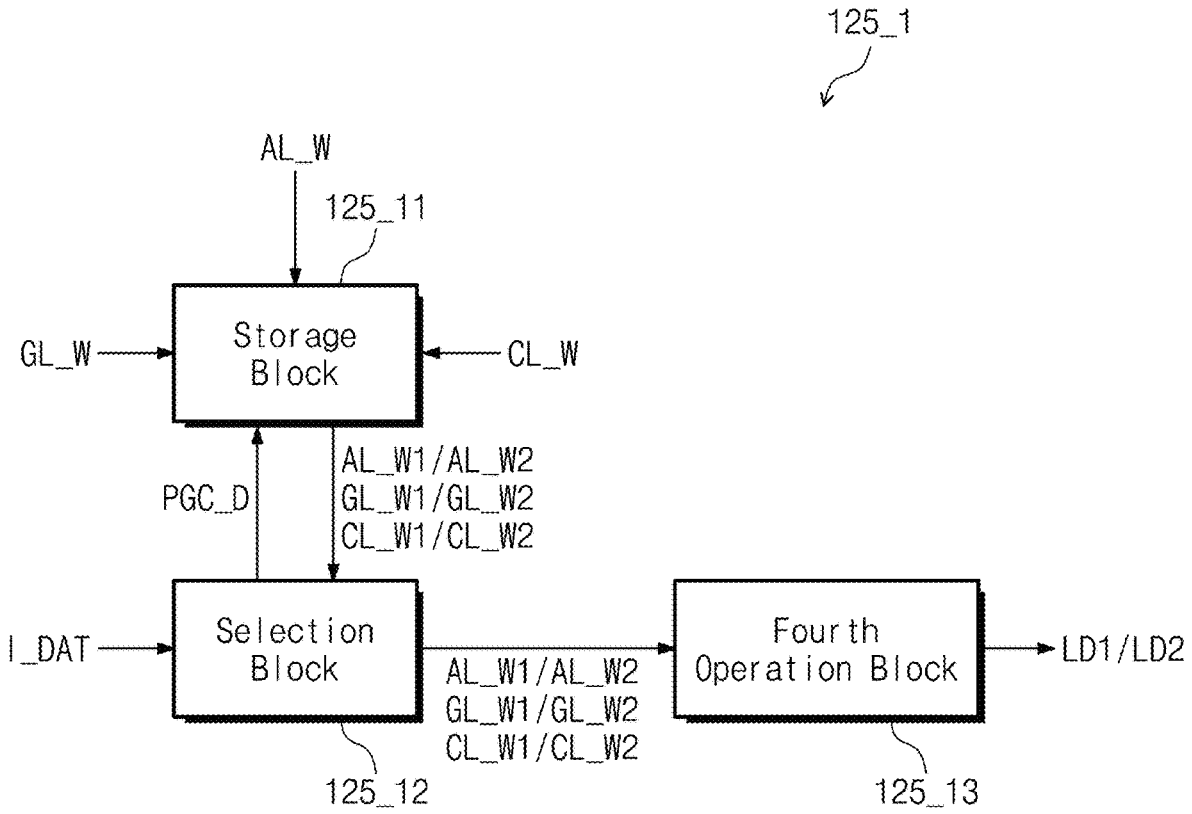
FIG. 6 is a block diagram showing the internal configuration of the load operation block shown in FIG. 4.

FIG. 4 is a block diagram of a current compensator according to an embodiment of the inventive concept. FIG. 5 is a block diagram showing the internal configuration of the current extraction block and first to third weight operation blocks shown in FIG. 4. FIG. 6 is a block diagram showing the internal configuration of the load operation block shown in FIG. 4.

Referring to FIGS. 3, 4 and 5, the current compensator 120 includes a current extraction block 121, a first weight operation block 122, a second weight operation block 123, a third weight operation block 124, and a data compensation block 125.

The current extraction block 121 may extract current for each grayscale of each of the measurement areas MA11 to MAij. The current extraction block 121 may include a plurality of sub extraction blocks 121_11 to 121_*ij* corresponding to the plurality of measurement areas MA11 to MAij, respectively. Each of the plurality of sub extraction blocks 121_11 to 121_*ij* extracts the current for each grayscale of a corresponding measurement area. For example, among the plurality of sub extraction blocks 121_11 to 121_*ij*, a first sub extraction block 121_11 extracts the current for each grayscale of a corresponding first measurement area MA11 among the plurality of measurement areas MA11 to MAij.

If grayscales that the input image data I_DAT may represent are 256, 256 measurement images corresponding to the 256 grayscales, respectively, are displayed in each of the measurement areas MA11 to MAij. Each of the sub extraction blocks 121_11 to 121_*ij* may extract 256 currents for the 256 measurement images displayed in the corresponding measurement area. Optionally, each of the sub extraction blocks 121_11 to 121_*ij* may extract currents for selected reference grayscales among the 256 grayscales. For example, if the number of the selected reference grayscales are 10, each of the sub extraction blocks 121_11 to 121_*ij* may extract only 10 currents for 10 measurement images corresponding to the 10 reference grayscales. Here, the number of reference grayscales is not particularly limited.

The current extraction block 121 may extract a current for each grayscale of the measurement areas MA11 to MAij by each color. That is, each of the sub extraction blocks 121_11 to **121_*ij* may extract the current for each color for a corresponding grayscale in each of the measurement areas MA11 to MAij. When the input image data I_DAT includes three color image data, each of the sub extraction blocks 121_11 to 121_*ij* may extract currents for each of the three colors for a corresponding grayscale. When the input image data I_DAT includes first color image data, second color image data and third color image data, each of the sub extraction blocks 121_11 to 121_*ij* may extract a current for the first color image data having a corresponding grayscale, a current for the second color image data for the corresponding grayscale, and a current for the third color image data for the corresponding grayscale. As an example of the inventive concept, the first color image data may be image data for red, the second color image data may be image data for green, and the third color image data may be image data for blue. In another embodiment, when the input image data includes four color image data, the current extraction block 121 may extract a current for each grayscale of each of the measurement areas MA11** to MAij by each of the four color image data.

The currents according to the grayscales of each of the measurement areas MA11 to MAij extracted from the current extraction block 121 may be referred to as extraction data EXC_D. Each of the extraction data EXC_D may include information on a measurement area, information on a grayscale, and information on a magnitude of the current. When each of the sub extraction blocks 121_11 to **121_*ij*** extracts a current for each color of a corresponding grayscale, each of the extraction data EXC_D may further include information on a color. The information on the measurement area may be information on the location of the corresponding measurement area.

The first weight operation block 122 calculates load weights GL_W (hereinafter referred to as grayscale load weights) according to the grayscales of the input image data I_DAT. As an example of the inventive concept, the first weight operation block 122 may include a maximum current detection block 122_1 and a first operation block 122_2. The maximum current detection block 122_1 receives the extraction data EXC D from the current extraction block 121. The maximum current detection block 122_1 detects the maximum current for each grayscale based on the extraction data EXC_D. When the input image data I_DAT is expressed in 256 grayscales, the maximum current detection block 122_1 may detect a maximum current for each of the 256 grayscales.

The maximum current detection block 122_1 may detect the maximum current for each grayscale by color. For example, the maximum current detection block 122_1 may detect the maximum current of the first color image data having a corresponding grayscale, the maximum current of the second color image data having the corresponding grayscale, and the maximum current of the third color image data having the corresponding grayscale from the extraction data EXC_D.

The maximum current for each grayscale detected from the maximum current detection block 122_1 may be referred to as maximum current data MC_D. Each of the maximum current data MC_D may include information on grayscale, information on the maximum magnitude of the current, and information on color.

The first operation block 122_2 receives the maximum current data MC_D and target gamma current data TG_D. The first operation block 122_2 compares the target gamma current data TG_D and the maximum current data MC_D for each grayscale, and generates a grayscale load weight GL_W for each grayscale. For example, the first operation block 122_2 may convert the target gamma current data TG_D of the grayscale to 1, multiply 1 by a ratio of the target gamma current data TG_D of the grayscale to the maximum current data MC_D of the grayscale, and generate the grayscale load weight GL_W of the corresponding grayscale. The grayscale load weight GL_W of the corresponding grayscale may be generated for each color. That is, the grayscale load weights GL_W may include first grayscale load weights for a first color, second grayscale load weights for a second color, and third grayscale load weights for a third color.

The second weight operation block 123 calculates load weights AL_W (hereinafter referred to as area load weights) for each of the measurement areas MA11 to MAij. As an example of the inventive concept, the second weight operation block 123 may include a second operation block 123_1.

The maximum current detection block 122_1 receives the extraction data EXC_D from the current extraction block 121, and detects a grayscale current for each measurement area MA11 to MAij based on the extraction data EXC_D. As an example of the inventive concept, the maximum current detection block 122_1 may further detect a current for the highest grayscale from the extracted current for each grayscale in each of the measurement area MA11 to MAij. As an example of the inventive concept, when the maximum grayscale is 255 grayscale, the maximum current detection block 122_1 may detect a current for 255 grayscale for each of the measurement areas MA11 to MAij. The maximum current detection block 122_1 may output maximum grayscale current data HGC_D including information on current for the maximum grayscale of each of the measurement areas MA11 to MAij. That is, each of the highest grayscale current data HGC_D may include information on the highest grayscale, information on the magnitude of the current, and information on a corresponding measurement area.

In addition, the maximum current detection block 122_1 may detect a current for the highest grayscale of each of the measurement areas MA11 to MAij by each color. For example, the maximum current detection block 122_1 may detect a current of the first color image data having the highest grayscale, a current of the second color image data having the highest grayscale, and a current of the third color image data having the highest grayscale for each of the measurement areas MA11 to MAij. In this case, each of the highest grayscale current data HGC_D may further include information on a corresponding color.

As an example of the inventive concept, the maximum current detection block 122_1 may further detect the maximum current among currents for the highest grayscale of the measurement areas MA11 to MAij. Information on the maximum current of the highest grayscale detected from the maximum current detection block 122_1 may be referred to as maximum current data MGC_D of the highest grayscale. When the highest grayscale is 255 grayscale, the maximum current detection block 122_1 may detect a measurement area having a maximum current for the 255 grayscale among all measurement areas. Accordingly, each of the maximum current data MGC_D of the highest grayscale outputted from the maximum current detection block 122_1 may include information on the highest grayscale, information on the maximum magnitude of the current, and information on a measurement area having the maximum current.

The maximum current detection block 122_1 may detect the maximum current for the highest grayscale by each color. For example, the maximum current detection block 122_1 detects a measurement area having the maximum current among currents of the first color image data having the highest grayscale extracted from the measurement areas MA11 to MAij, and detects a measurement area having the maximum current among currents of the second color image data having the highest grayscale extracted from the measurement areas MA11 to MAij. In addition, the maximum current detection block 122_1 may detect a measurement area having the maximum current among currents of the third color image data having the highest grayscale extracted from the measurement areas MA11 to MAij. In this case, each of the maximum current data MGC_D of the highest grayscale may further include color information.

The second operation block 123_1 may receive the highest grayscale current data HGC_D and the maximum current data MGC_D of the highest grayscale from the maximum current detection block 122_1. The second operation block 123_1 may calculate the area load weights AL_W based on the highest grayscale current data HGC_D and the maximum current data MGC_D of the highest grayscale.

The second operation block 123_1 generates the area load weight AL_W for each of the highest grayscale current data HGC_D based on the maximum current data MGC_D of the highest grayscale. For example, the second operation block 123_1 may convert the magnitude of the current (that is, the maximum magnitude of the current) of the highest current data HGC_D to 1, multiply 1 by the ratio of the magnitude of the current of the highest grayscale current data HGC_D to the maximum magnitude of the current, and generate the area load weight AL_W for each of the highest grayscale current data HGC_D. The area load weight AL_W for each of the highest grayscale current data HGC_D may be generated for each measurement area. In FIG. 5, the embodiment that the second operation block 123_1 receives the highest grayscale current data HGC_D is described. However, the invention is not limited thereto. In another embodiment, the second operation block 123_1 may receive the reference grayscale current data instead of the highest grayscale current data HGC_D, and the highest grayscale current data HGC_D may be an example of the reference grayscale current data.

The area load weight AL_W of each of the measurement areas MA11 to MAij generated from the second weight operation block 123 may be generated for each color. That is, the second weight operation block 123 may generate area load weights for the first color, area load weights for the second color, and area load weights for the third color.

The third weight operation block 124 calculates load weights CL_W (hereinafter referred to as color load weights) for each color. As an example of the inventive concept, the third weight operation block 124 may include a third operation block 124_1. The third operation block 124_1 may receive the highest grayscale current data HGC_D for each color of each of the measurement areas MA11 to MAij from the maximum current detection block 122_1. The third operation block 124_1 may calculate the color load weight CL_W for each color of each of the measurement areas MA11 to MAij based on the highest grayscale current data HGC_D. The color load weight CL_W for each of the measurement areas MA11 to MAij includes a first color load weight for a first color, a second color load weight for a second color, and a third color load weight for a third color. The sum of the first to third color load weights for each of the measurement areas MA11 to MAij may be 1. In FIG. 5, the embodiment that the third operation block 124_1 may receive the highest grayscale current data HGC_D is described. However, the invention is not limited thereto. In another embodiment, the third operation block 124_1 may receive the reference grayscale current data instead of the highest grayscale current data HGC_D, and the highest grayscale current data HGC_D may be an example of the reference grayscale current data.

The third operation block 124_1 detects a current value (hereinafter, referred to as a first current value) corresponding to the first color image data having the highest grayscale for a corresponding measurement area from the highest grayscale current data HGC_D. The third operation block 124_1 detects a current value (hereinafter, referred to as a second current value) corresponding to the second color image data having the highest grayscale for a corresponding measurement area from the highest grayscale current data HGC_D. Also, the third operation block 124_1 detects a current value (hereinafter, a third current value) corresponding to the third color image data having the highest grayscale for a corresponding measurement area from the highest grayscale current data HGC_D. The sum of the first to third current values is referred to as the total current value. The third operation block 124_1 may calculate a first current value for a total current value as a first color load weight of a corresponding measurement area. In addition, the third operation block 124_1 may calculate the second current value for the total current value as the second color load weight of the corresponding measurement area, and calculate the third current value with respect to the total current value as the third color load weight of the corresponding measurement area. Accordingly, the sum of the first to third color load weights for each of the measurement areas MA11 to MAij may be 1.

Referring to FIGS. 4 and 6, the data compensation block 125 may receive the grayscale load weights GL_W, the area load weights AL_W, and the color load weights CL_W from the first to third weight operation blocks 122, 123, and 124. The data compensation block 125 compensates the input image data I_DAT to generate the compensation image data RGB based on the grayscale load weights GL_W, the area load weights AL_W, and the color load weights CL_W.

As an example of the inventive concept, the data compensation block 125 may include a load operation block 125_1 and a current control block 125_2. The load operation block 125_1 may receive the grayscale load weights GL_W, the area load weights AL_W, and the color load weights CL_W from the first to third weight operation blocks 122, 123, and 124, respectively. The load operation block 125_1 may include a storage block 125_11 that stores the grayscale load weights GL_W, the area load weights AL_W, and the color load weights CL_W. The grayscale load weights GL_W, the area load weights AL_W, and the color load weights CL_W stored in the storage block 125_11 may be periodically updated.

The load operation block 125_1 may further include a selection block 125_12 and a fourth operation block 125_13. The selection block 125_12 receives the input image data I_DAT, and generates reading data PGC_D including position, grayscale, and color information on the input image data I_DAT. The selection block 125_12 may read necessary load weights from the storage block 125_11 based on the reading data PGC_D. For example, if the input image data I_DAT corresponds to a 20% box peak white image, the selection block 125_12 may load area load weights (hereinafter, first region load weights AL_W1) corresponding to the position of the 20% box, grayscale load weights (hereinafter, first grayscale load weights GL_W1) corresponding to the highest grayscale (e.g., 255 grayscale), and color load weights corresponding to the position of the 20% box (hereinafter, first color load weights CL_W1), from the storage block 125_11.

The selection block 125 12 provides the first area load weights AL_W1, the first grayscale load weights GL_W1, and the first color load weights CL_W1 to the fourth operation block 125_13. The fourth operation block 125_13 may calculate a load (hereinafter, referred to as a first load LD1) for the input image data I_DAT based on the first area load weights AL_W1, the first grayscale load weights GL_W1, and the first color load weights CL_W1. As an example of the inventive concept, when a 20% box corresponds to a plurality of measurement areas, the selection block 125_12 outputs the area load weights AL_W for the corresponding measurement area as first area load weights AL_W1. The fourth operation block 125_13 may calculate an average value of the first area load weights AL_W1 and use the average value of the first area load weights AL_W1 to calculate the first load LD1.

On the other hand, if the input image data I_DAT corresponds to a 100% box full white image, the selection block 125_12 may load area load weights (hereinafter, second area load weights AL_W2) corresponding to the position of the 100% box, grayscale load weights (hereinafter, second grayscale load weights GL_W2) corresponding to an intermediate grayscale (e.g., 149 grayscale), and color load weights (hereinafter, second color load weights CL_W2) corresponding to the 100% box position from the storage block 125_11.

The selection block 125_12 provides the second area load weights AL_W2, the second grayscale load weights GL_W2, and the second color load weights CL_W2 to the fourth operation block 125_13. The fourth operation block 125_13 may calculate a load (hereinafter, referred to as a second load LD2) for the input image data I_DAT based on the second area load weights AL_W2, the second grayscale load weights GL_W2, and the second color load weights CL_W2. As an example of the inventive concept, when a 100% box corresponds to all measurement areas, the selection block 125_12 outputs the area load weights AL_W for all measurement areas as second area load weights AL_W2. The fourth operation block 125_13 may calculate an average value of the second area load weights AL_W2 and use the average value of the second area load weights AL_W2 to calculate the second load LD2. A program including an algorithm for calculating the first and second loads LD1 and LD2 may be stored in the fourth operation block 125_13.

FIG. 6 illustrates a structure in which the storage block 125_11 is embedded in the load operation block 125_1, but the storage block 125_11 may be disposed independently from the load operation block 125_1.

Referring back to FIGS. 4 and 6, the current control block 125_2 receives the finally calculated load LD from the load operation block 125_1. The load LD may be the first load LD1 or the second load LD2. The current control block 125_2 may read the target current TGC corresponding to the load LD from the target current storage block 125_3. The target current storage block 125_3 may include a look-up table in which the target current TGC is stored according to the size of the load LD.

When the input image data I_DAT is displayed on the display panel DP, the sensing current SE_C sensed from the display panel DP may be provided to the current control block 125_C. The current control block 125_2 may compare the sensing current SE_C and the target current TG_C and compensate the input image data I_DAT according to the difference between the sensing current SE_C and the target current TG_C to generate the compensation image data RGB. That is, when an image is displayed on the display panel DP using the compensation image data RGB, the image may have a desired target luminance. A program including a current compensation algorithm for compensating the input image data I_DAT so that an image corresponding to the input image data I_DAT has a target luminance may be stored in the current control block 125_2.

In calculating the load LD required to compensate the input image data I_DAT, the current compensator 120 may generate load weights GL_W, AL_W, and CL_W in consideration of differences in efficiency of various variables (e.g., location, grayscale, color, and the like) affecting the load LD. Accordingly, the luminance compensation may be accurately performed according to the input image data I_DAT through the current compensator 120 according to the inventive concept, and as a result, the overall luminance characteristics of the display device DD may be improved.

Figure 7A:
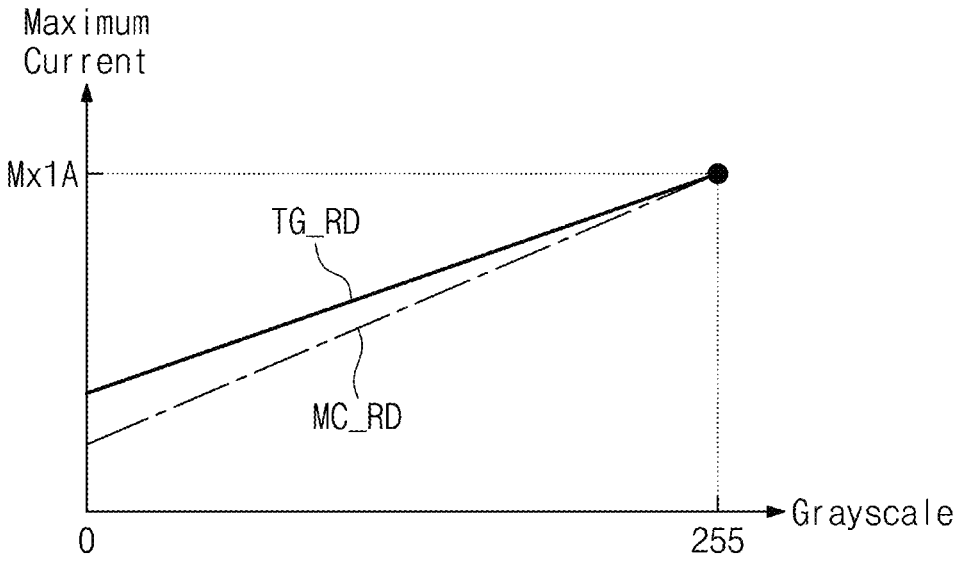
FIGS. 7A to 7D are graphs for explaining a first weight operation block in FIG. 5.
Figure 7B:
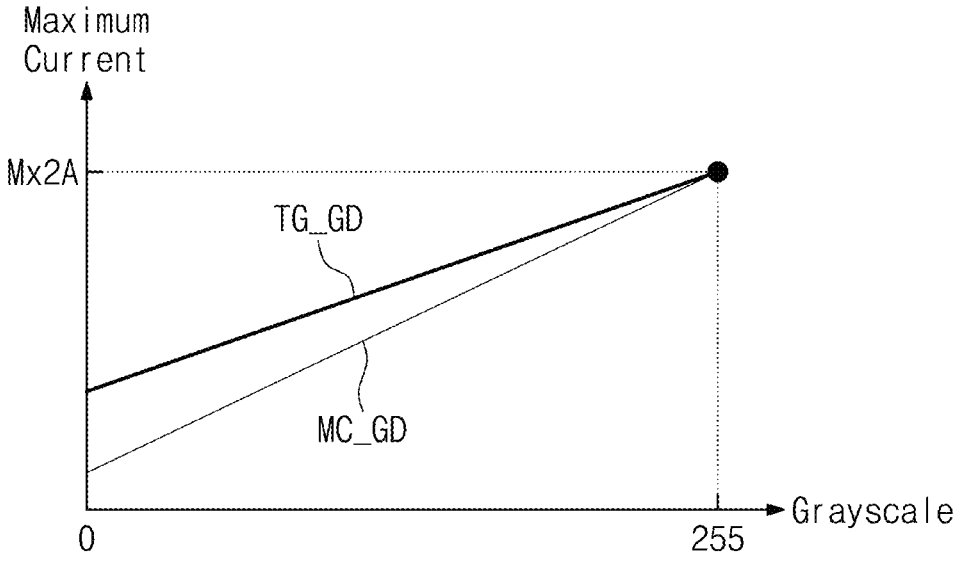
Figure 7C:
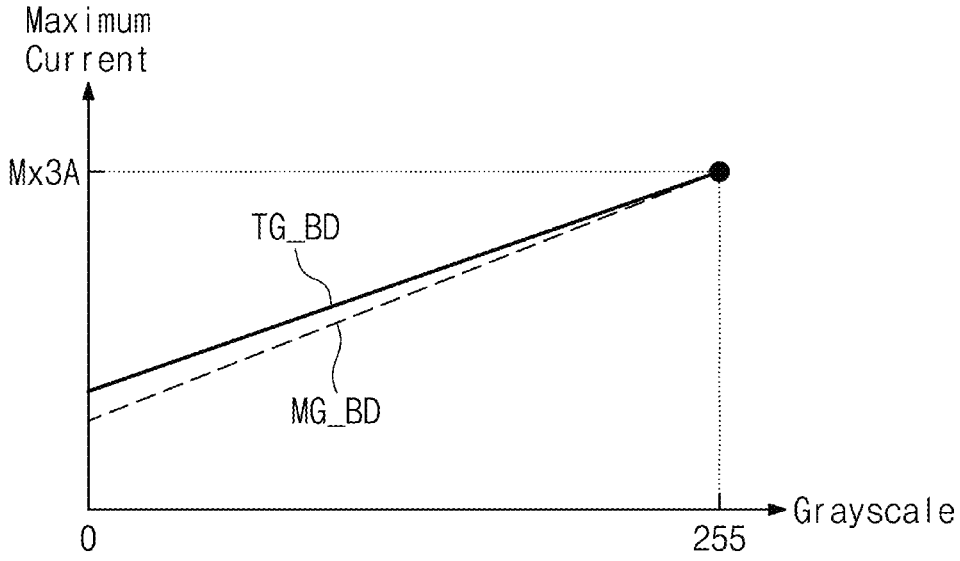

FIGS. 7A to 7D are graphs for explaining a first weight operation block in FIG. 5. In FIGS. 7A to 7C, an x-axis represents grayscale, and a y-axis represents the magnitude of the maximum current.

In FIG. 7A, a first graph (i.e., solid line) represents the maximum current (hereinafter, a first target maximum current TG_RD) according to each grayscale of the first color (e.g., red) image data having a target gamma, and a second graph (i.e., dot-dashed broken lines) represents the maximum current (hereinafter, a first color maximum current MC_RD) according to each grayscale of the first color image data measured on the actual display panel DP. In FIG. 7A, the maximum current for the highest gradation (e.g., 255 grayscale) of the first color image data is denoted as "Mx1A". In FIG. 7B, the third graph (i.e., solid line) represents the maximum current (hereinafter, a second target maximum current TG_GD) according to each grayscale of the second color (e.g., green) image data having a target gamma, and the fourth graph (i.e., dot-dashed broken lines) represents the maximum current (hereinafter, referred to as a second color maximum current MC_GD) according to each grayscale of the second color image data measured on the actual display panel DP. In FIG. 7B, the maximum current for the highest gradation (e.g., 255 grayscale) of the second color image data is denoted as "Mx2A". In FIG. 7C, the fifth graph (i.e., solid line) represents the maximum current (hereinafter, a third target maximum current TG_BD) according to each grayscale of the third color (e.g., blue) image data having a target gamma, and the sixth graph (i.e., dot-dashed broken lines) represents the maximum current (hereinafter, a third color maximum current MC_BD) according to each grayscale of the third color image data measured on the actual display panel DP. In FIG. 7C, the maximum current for the highest gradation (e.g., 255 grayscale) of the third color image data is denoted as "Mx3A".

Figure 7D:
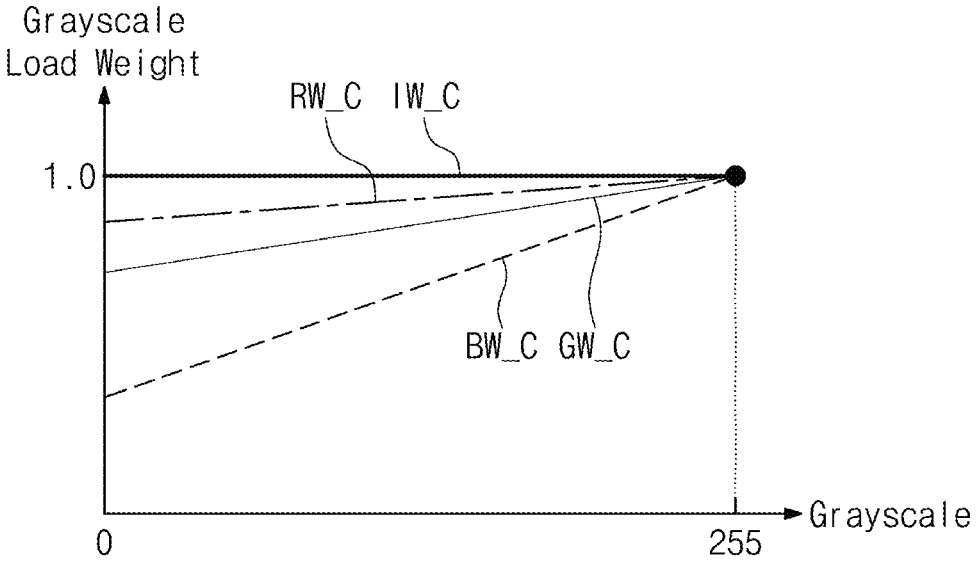

In FIG. 7D, the x-axis represents the grayscale, and the y-axis represents the size of the grayscale load weight. In FIG. 7D, an ideal weight curve IW_C expressed by converting the first to third target maximum currents TG_RD, TG_GD, and TG_BD into 1 is shown. In addition, FIG. 7D shows a grayscale load weight curve RW_C for the first color, a grayscale load weight curve GW_C for the second color, and a grayscale load weight curve BW_C for the third color.

Referring to FIGS. 4, 5, and 7A to 7D, the first weight operation block 122 generates grayscale load weights GL_W according to grayscale of input image data I_DAT. The grayscale load weights GL_W may be generated for each color. As an example of the inventive concept, the first weight operation block 122 receives the extraction data EXC_D including current information extracted by grayscale for each measurement area from the current extraction block 121. The first weight operation block 122 extracts the maximum current for each grayscale based on the extraction data EXC_D. When the input image data I_DAT is expressed in 256 grayscales and has 256 grayscales, the first weight operation block 122 may detect the maximum current for 256 grayscales.

The first weight operation block 122 may detect the maximum current for each grayscale by each color. For example, the first weight operation block 122 may detect the first color maximum currents MC_RD for the first color image data for each grayscale from the extraction data EXC_D, and the second color maximum currents MC_GD for the second color image data for each grayscale from the extraction data EXC_D. Also, the first weight operation block 122 may detect the third color maximum currents MC_BD for the third color image data for each grayscale from the extraction data EXC_D.

The first weight operation block 122 may calculate a ratio of the first color maximum current MC_RD to the first target maximum current TG_RD in each grayscale as a grayscale load weight for the first color of each grayscale. In addition, the first weight operation block 122 may calculate the ratio of the second color maximum current MC_GD to the second target maximum current TG_GD in each grayscale as a grayscale load weight for the second color of each grayscale. Finally, the first weight operation block 122 may calculate the ratio of the third color maximum current MC_BD to the third target maximum current TG_BD in each grayscale as a grayscale load weight for the third color of each grayscale.

When converting the first to third target maximum currents TG_RD, TG_GD, and TG_BD for each grayscale into 1, each of the grayscale load weights for the first color of each grayscale, the grayscale load weights for the second color, and the grayscale load weights for the third color may be less than or equal to 1.

Figure 8A:
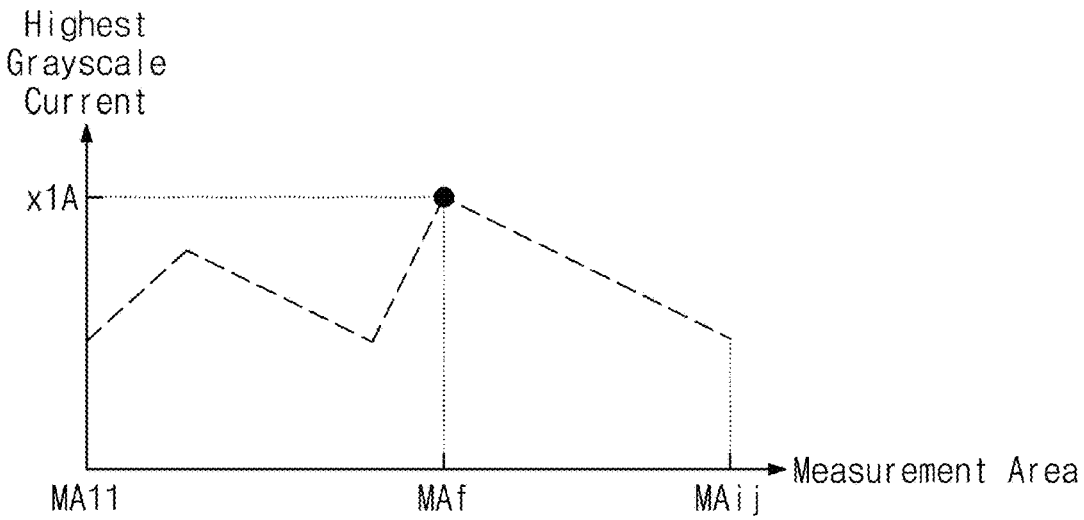
FIGS. 8A to 8C are graphs showing currents for the highest grayscale for each measurement area for the first to third colors shown in FIG. 5.
Figure 8B:
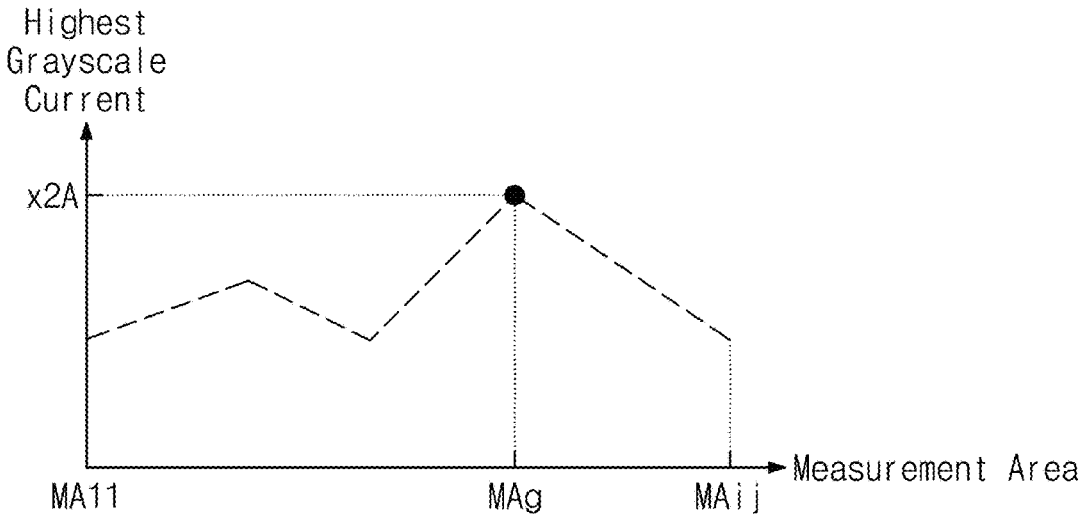
Figure 8C:
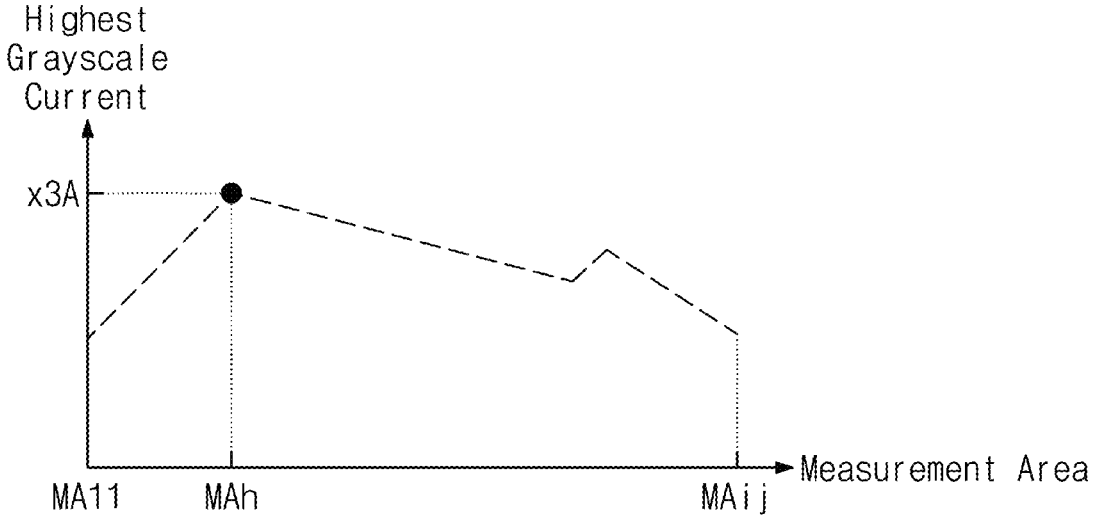
Figure 9A:
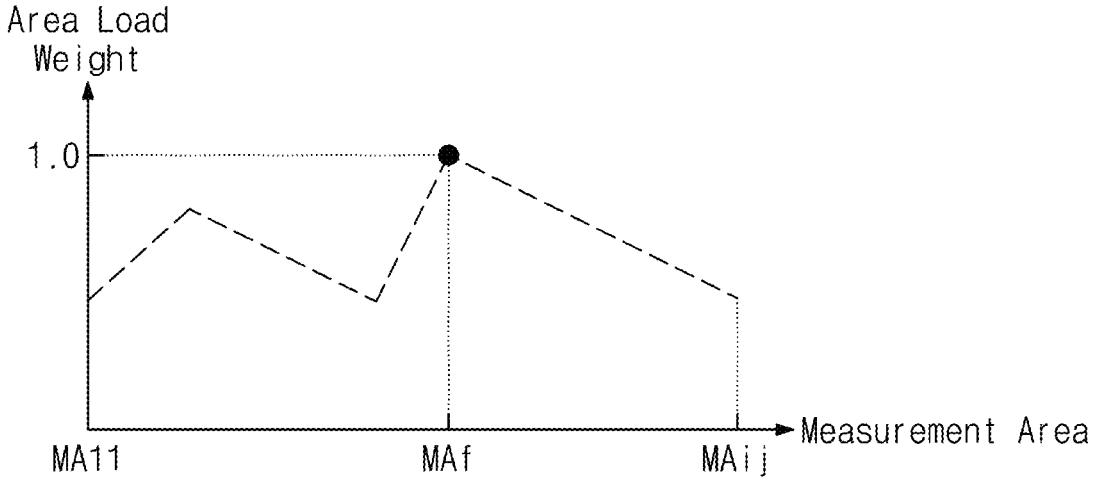
FIGS. 9A to 9C are graphs for explaining the operation of the second weight operation block shown in FIG. 5.
Figure 9B:
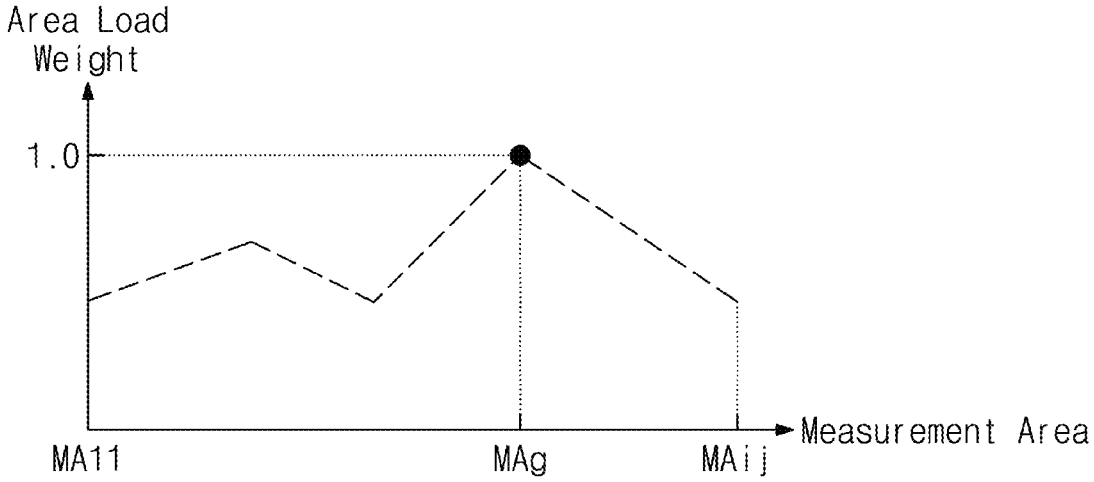
Figure 9C:
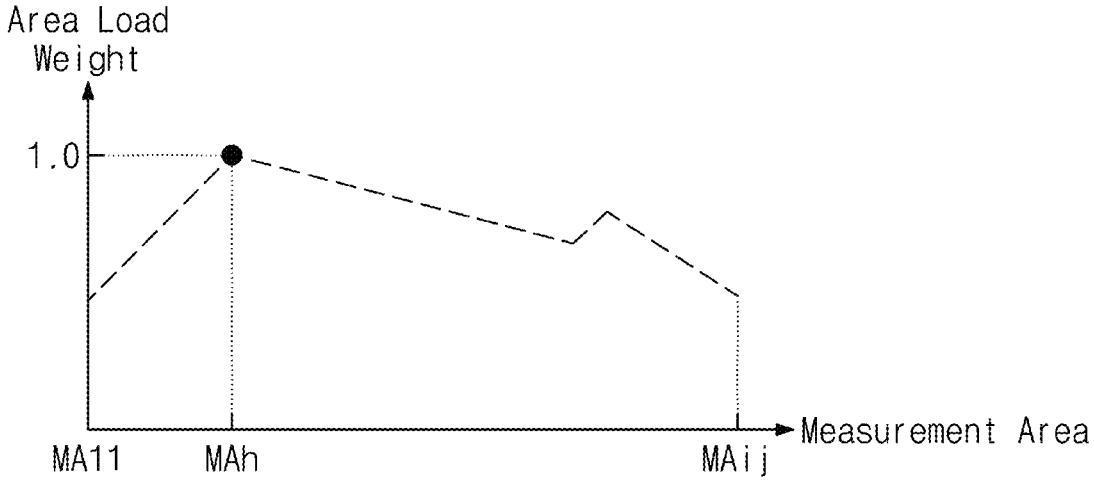

FIGS. 8A to 8C are graphs showing currents for the highest grayscale for each measurement area for the first to third colors shown in FIG. 5, and FIGS. 9A to 9C are graphs for explaining the operation of the second weight operation block shown in FIG. 5. In FIGS. 8A to 8C, an x-axis represents measurement areas MA11 to MAij, and a y-axis represents the magnitude of the current for the highest grayscale. In FIGS. 9A to 9C, the x-axis represents measurement areas MA11 to MAij, and the y-axis represents the size of the area load weight.

Referring to FIGS. 4, 5, and 8A to 9C, the second weight operation block 123 generates the area load weights AL_W for the measurement areas MA11 to MAij. The area load weights AL_W may be generated for each color. The second weight operation block 123 receives the highest grayscale current data HGC_D from the first weight operation block 122. The highest grayscale current data HGC_D may include current information at the highest grayscale for each measurement area. The first weight operation block 122 may detect current information at the highest grayscale for each measurement area for each color.

As shown in FIGS. 8A to 8C, the highest grayscale current data HGC_D may include current information (hereinafter, first highest grayscale currents) for the first color image data having the highest grayscale in the measurement areas MA11 to MAij, current information (hereinafter, second highest grayscale currents) for the second color image data having the highest grayscale in the measurement areas MA11 to MAij, and current information (hereinafter, third highest grayscale currents) for the third color image data having the highest grayscale in the measurement areas MA11 to MAij.

The second weight operation block 123 may extract a first maximum current x1A having the largest magnitude among the first highest grayscale currents, extract a second maximum current x2A having the largest magnitude among the second highest grayscale currents, and extract a third maximum current x3A having the largest magnitude among the third highest grayscale currents. The measurement area having the first maximum current x1A among the plurality of measurement areas MA11 to MAij may be referred to as a first measurement area MAf, the measurement area having the second maximum current x2A among the plurality of measurement area areas MA11 to MAij may be referred to as a second measurement area MAg, and the measurement area having a third maximum current x3A among the plurality of measurement area areas MA11 to MAij may be referred to as a third measurement area MAh. FIGS. 8A to 8C illustrate that the first to third measurement areas MAf, MAg, and MAh are at different positions, but the inventive concept is not limited thereto. That is, at least two of the first to third maximum currents x1A, x2A, and x3A may be detected in the same measurement area in another embodiment.

As shown in FIGS. 5 and 9A to 9C, the second weight operation block 123 converts the first maximum current x1A into "1.0", and calculates the ratio of the first highest grayscale currents to the first maximum current x1A as area load weights for the first color. The first measurement area MAf having a first maximum current x1A among the measurement areas MA11 to MAij has an area load weight corresponding to "1.0" for the first color, and measurement areas other than the first measurement area MAf may have an area load weight less than "1.0" for the first color.

The second weight operation block 123 converts the second maximum current x2A into "1.0", and calculates the ratio of the second highest grayscale currents to the second maximum current x2A as area load weights for the second color. The second measurement area MAg having a second maximum current x2A among the measurement areas MA11 to MAij has an area load weight corresponding to "1.0" for the second color, and measurement areas other than the second measurement area MAg may have an area load weight less than "1.0" for the second color.

The second weight operation block 123 converts the third maximum current x3A to "1.0", and calculates the ratio of the third highest grayscale currents to the third maximum current x3A as the area load weights for the third color. The third measurement area MAh having the third maximum current x3A among the measurement areas MA11 to MAij has an area load weight corresponding to "1.0" for the third color, and measurement areas other than the third measurement area MAh may have an area load weight less than "1.0" for the third color.

Figure 10A:
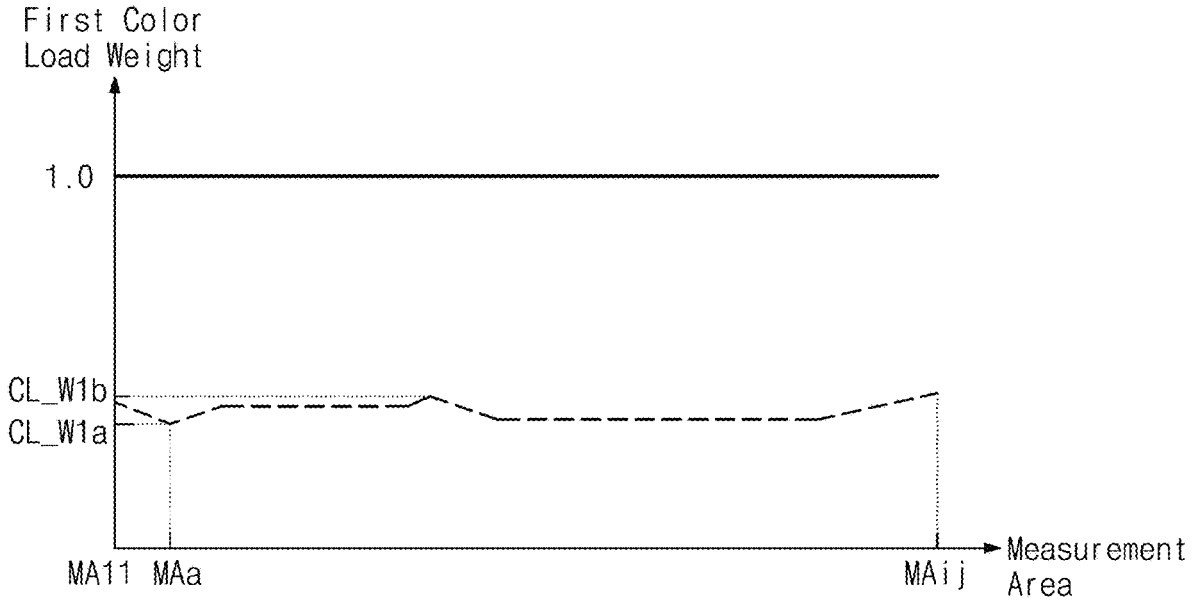
FIGS. 10A to 10C are graphs for explaining the operation of the third weight operation block shown in FIG. 5.
Figure 10B:
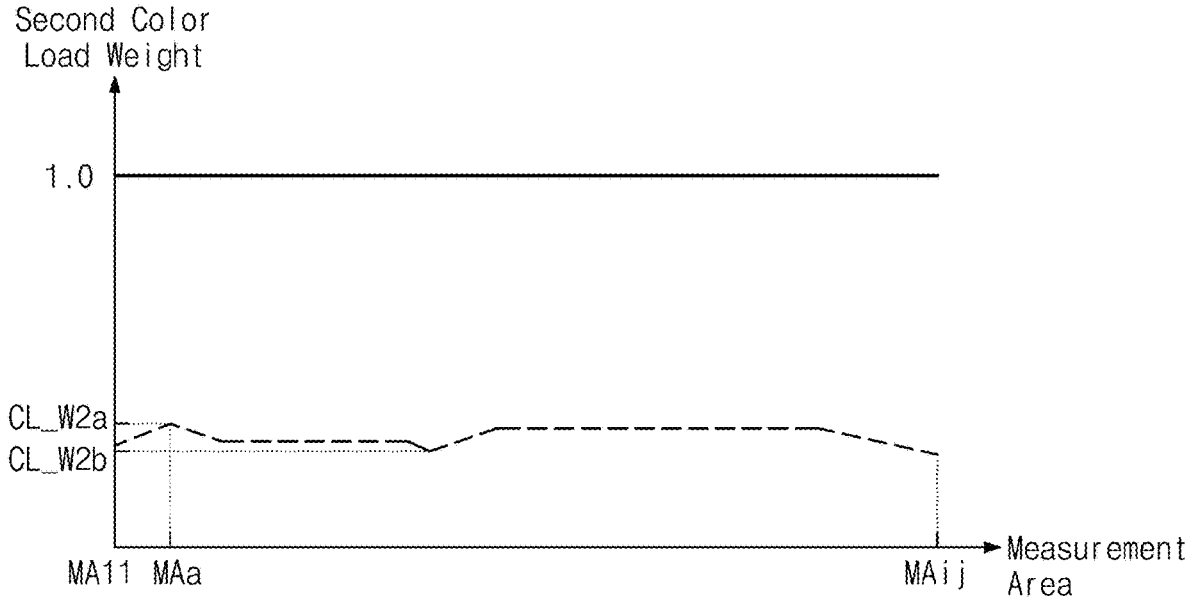
Figure 10C:
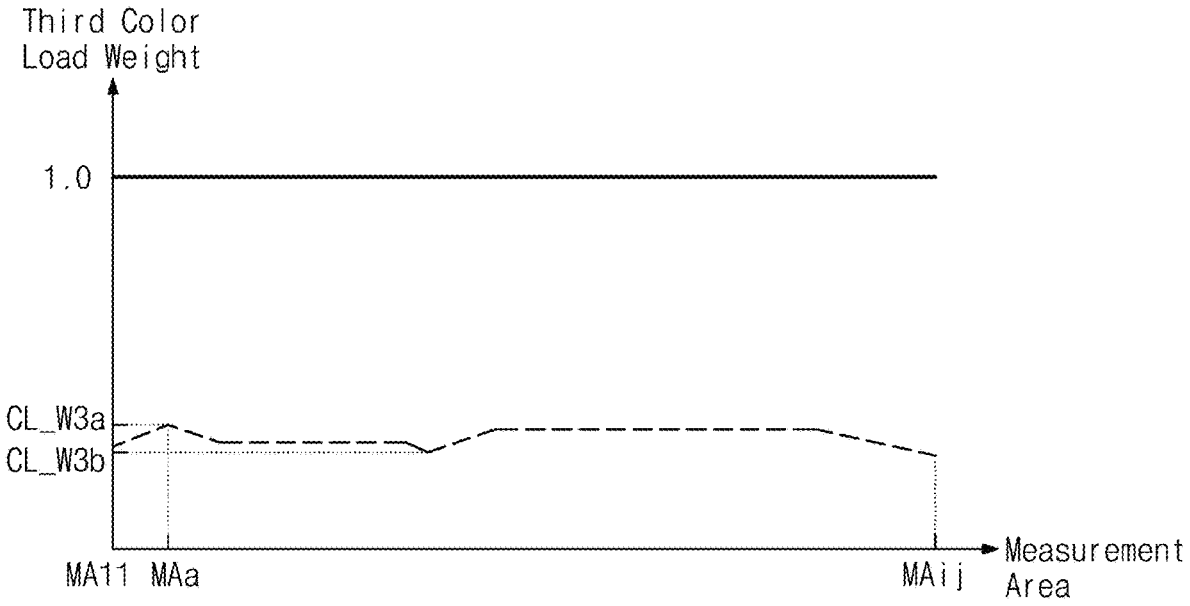

FIGS. 10A to 10C are graphs for explaining the operation of the third weight operation block shown in FIG. 5.

FIGS. 4, 5, 8A to 8C, and 10A to 10C, the third weight operation block 124 may generate the color load weights CL_W. The color load weights CL_W may include first color load weights for each of the measurement areas MA11 to MAij for the first color, second color load weights for each of the measurement areas MA11 to MAij for the second color, and third color load weights for each of the measurement areas MA11 to MAij for the third color.

For the corresponding measurement area (hereinafter, the fourth measurement area MAa), the third weight operation block 124 detects a current value (hereinafter, a first current value) corresponding to the first color image data having the highest grayscale, a current value (hereinafter, a second current value) corresponding to the second color image data having the highest grayscale, and a current value (hereinafter, a third current value) corresponding to the third color image data having the highest grayscale from the highest grayscale current data HGC_D. The sum of the first to third current values is referred to as the total current value.

The third weight operation block 124 may calculate the first current value for the total current value as a first color load weight CL_W1*a* of the fourth measurement area MAa. In addition, the third weight operation block 124 may calculate the second current value for the total current value as a second color load weight CL_W2*a* of the fourth measurement area MAa, and calculate the third current value with respect to the total current value as a third color load weight CL_W3*a* of the fourth measurement area MAa. Here, the sum of the first to third color load weights CL_W1*a*, CL_W2*a*, and CL_W3*a* for the fourth measurement area MAa may be 1.

Figure 11A:
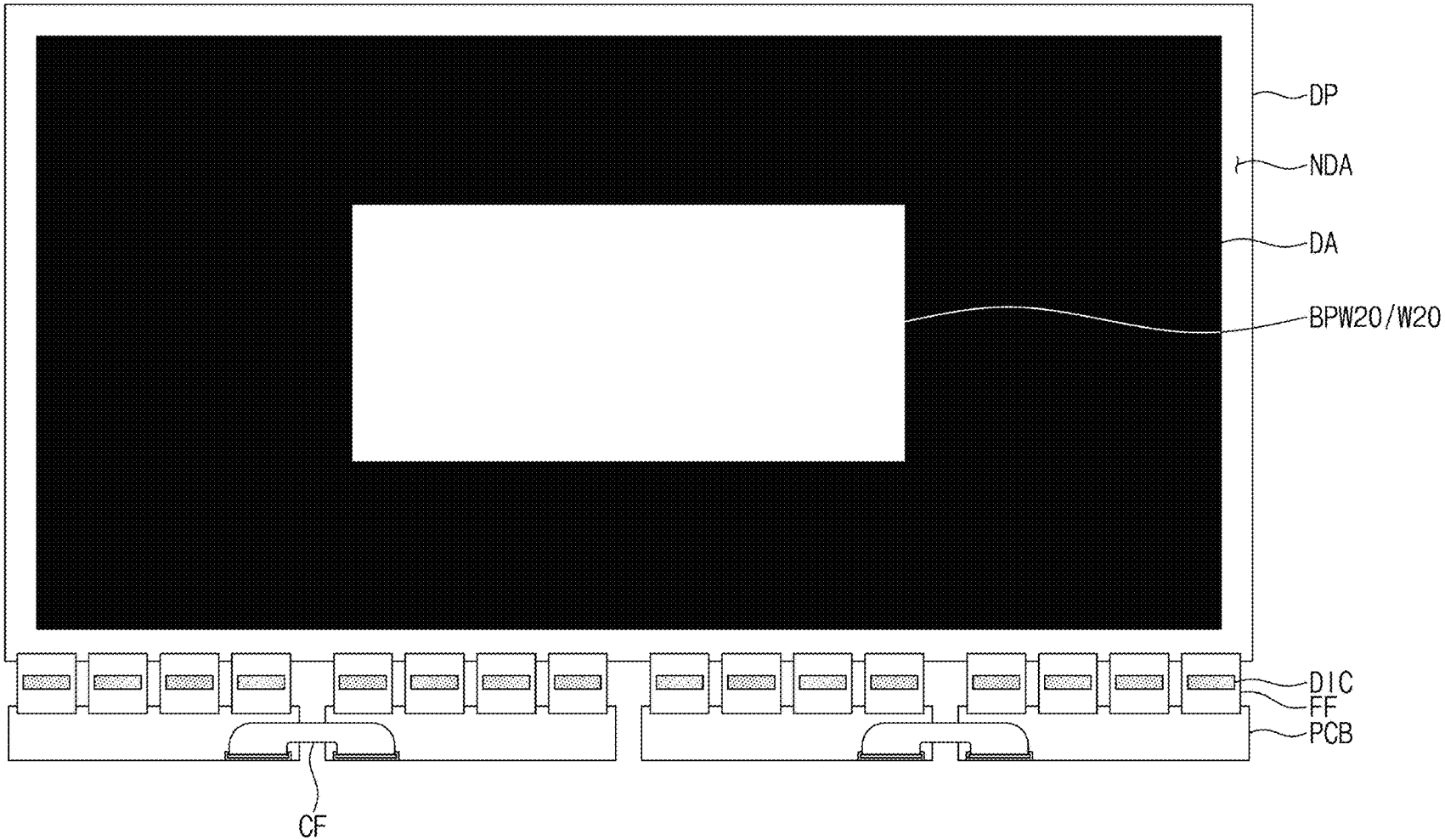
FIG. 11A is a plan view illustrating a display device displaying a 20% box peak white image.
Figure 11B:
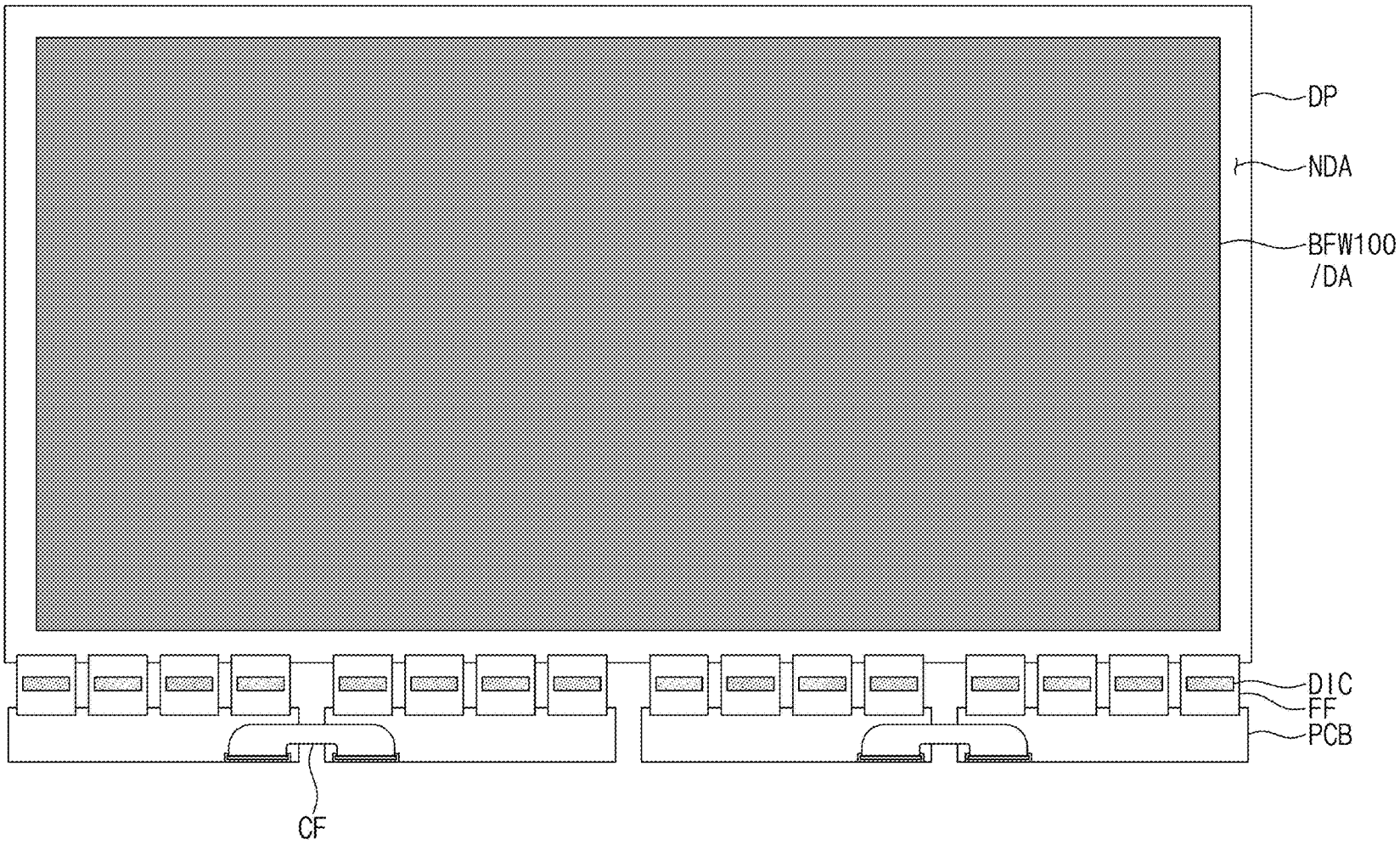
FIG. 11B is a plan view illustrating a display device displaying a 100% box full white image.

FIG. 11A is a plan view illustrating a display device displaying a 20% box peak white image, and FIG. 11B is a plan view illustrating a display device displaying a 100% box full white image.

Referring to FIGS. 4, 6, 11A and 11B, as an example of the inventive concept, the current compensator 120 may receive input image data I_DAT corresponding to a first image including a peak white image BPW20 of 20% box. The first image may further include a black image adjacent to the peak white image. The peak white image BPW20 may be displayed in a white area W20 having a size corresponding to 20% of the total display area DA, and may be defined as an image displaying a white color at the highest grayscale. The black image may be displayed in the remaining areas of the display area DA except for the white area W20, and may be defined as an image displaying a black color at the lowest grayscale.

The current compensator 120 selects first area load weights corresponding to the white area W20 from the area load weights AL_W, selects first grayscale load weights corresponding to the highest grayscale (e.g., 255 grayscale) from the grayscale load weights GL_W, and selects first to third color load weights corresponding to the white area W20 from the color load weights CL_W.

The current compensator 120 may calculate a first load LD1 (refer to FIG. 6) for the first image based on first area load weights, first grayscale load weights, and first to third color load weights. That is, in calculating the first load LD1, efficiency for each area, efficiency for each grayscale, and efficiency for each color may be reflected. For example, if the highest grayscale is less efficient than the intermediate grayscale, by applying the first grayscale load weights when calculating the first load LD1 for the first image, the efficiency of each grayscale may be reflected in luminance compensation for the first image.

As an example of the inventive concept, the current compensator 120 may receive input image data I_DAT corresponding to a second image including a full white image BFW100 of a 100% box. The full white image BFW100 is displayed on the entire display area DA, and may be defined as an image displaying white color at an intermediate grayscale.

The current compensator 120 selects second area load weights corresponding to the entire display area DA from the area load weights AL_W, selects second grayscale load weights corresponding to the intermediate grayscale (e.g., 125 grayscale) from the grayscale load weights GL_W, and selects first to third color load weights corresponding to the entire display area DA from the color load weights CL_W.

The current compensator 120 may calculate a second load LD2 (refer to FIG. 6) based on the second area load weights, the second grayscale load weights, and the first to third color load weights. That is, in calculating the second load LD2, efficiency for each area, efficiency for each grayscale, and efficiency for each color may be reflected. For example, if the intermediate grayscale is more efficient than the highest grayscale, by applying the second grayscale load weights when calculating the second load LD2 for the second image, the efficiency for each grayscale may be reflected in the luminance compensation for the second image.

Therefore, the current compensator 120 according to the inventive concept may improve the problem that the luminance of the first image displayed at the highest grayscale with relatively low efficiency is compensated to be lower than the desired luminance, or the luminance of the second image displayed in an intermediate grayscale with relatively high efficiency is compensated to be higher than the desired luminance.

Figure 12A:
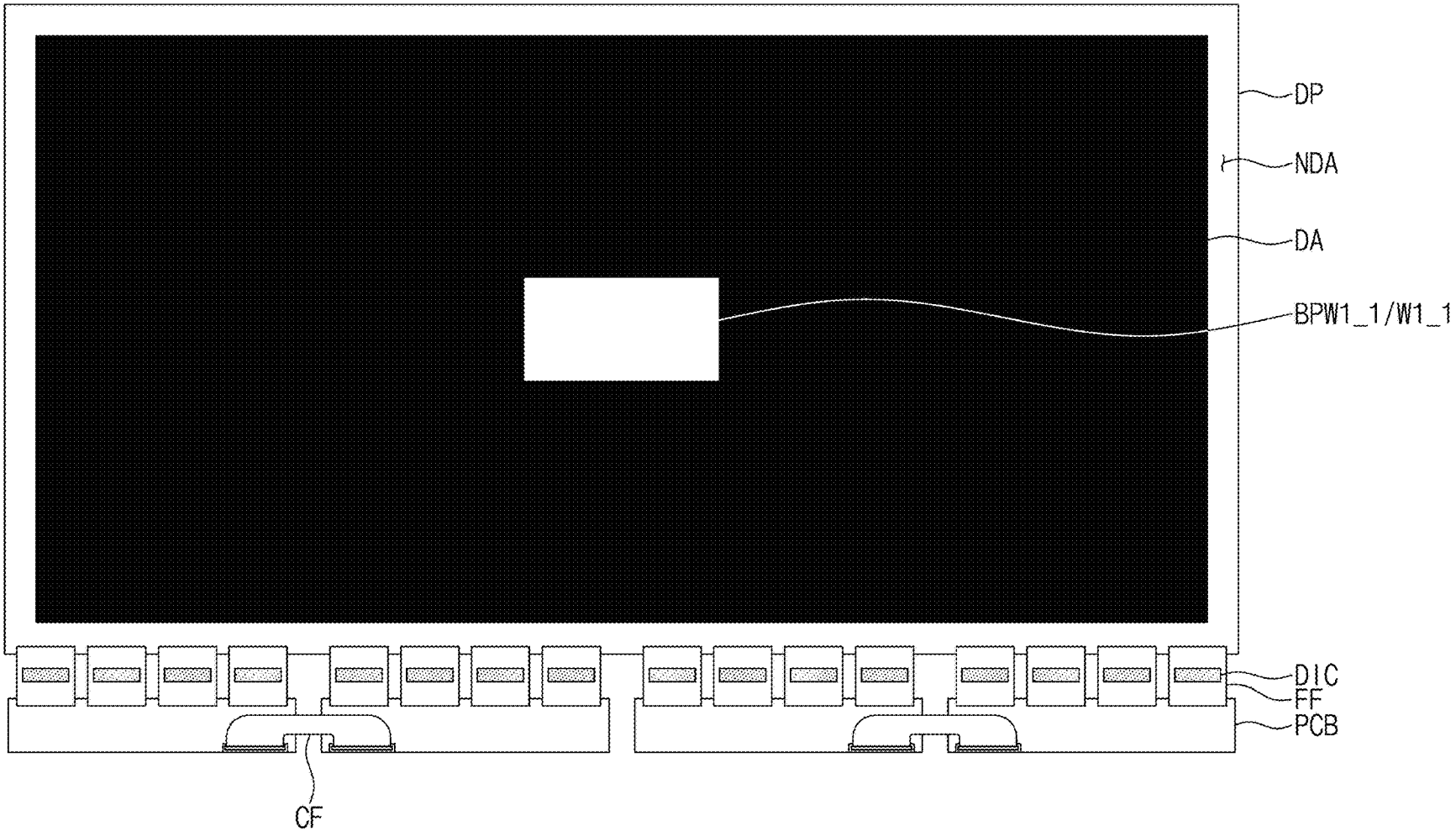
FIG. 12A is a plan view illustrating a display device displaying a 1% box peak white image at a first position.
Figure 12B:
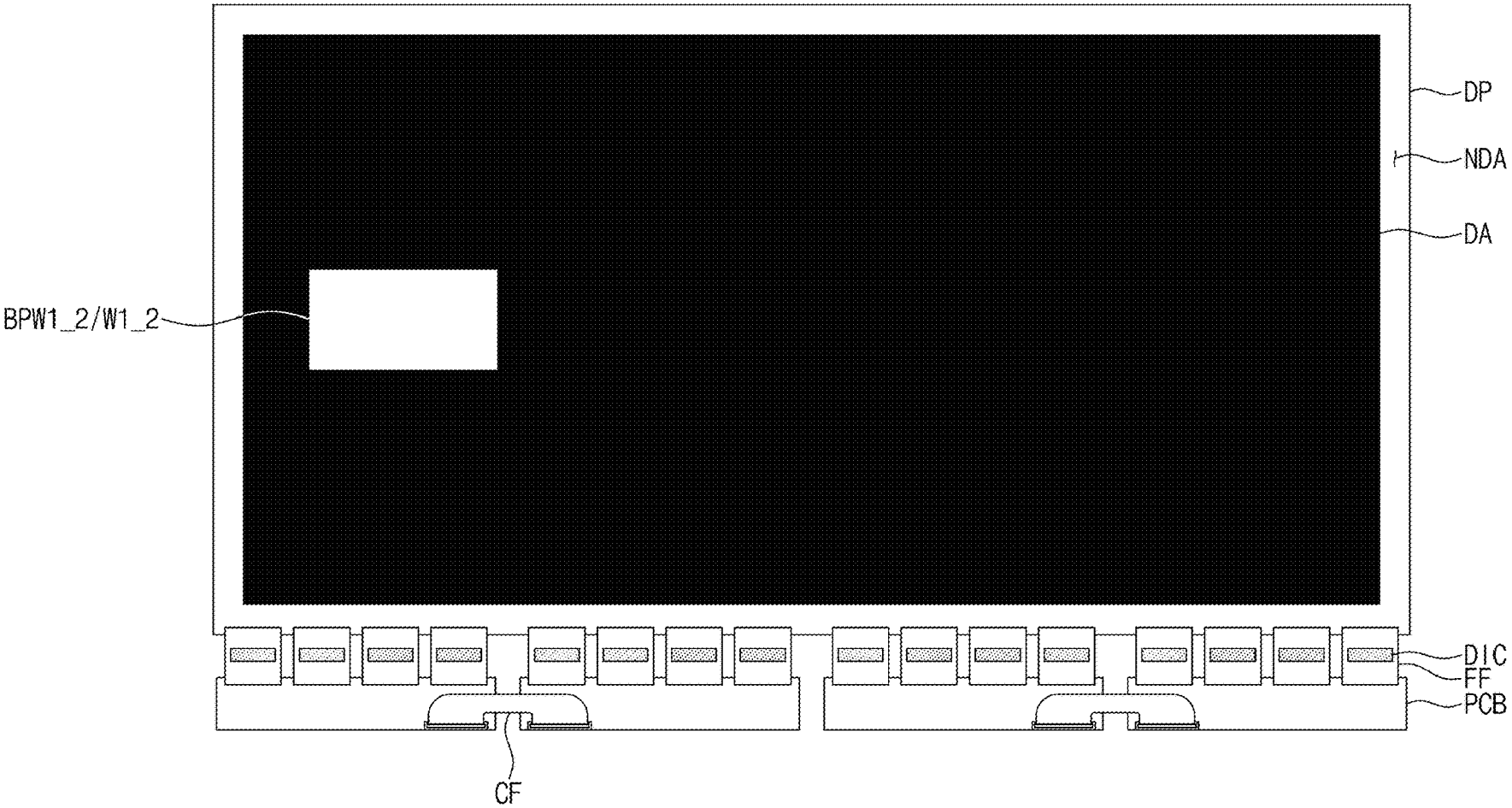
FIG. 12B is a plan view illustrating a display device displaying a 1% box peak white image at a second position.

FIG. 12A is a plan view illustrating a display device displaying a 1% box peak white image in a first position, and FIG. 12A is a plan view illustrating a display device displaying a 1% box peak white image in a second position.

Referring to FIGS. 4, 6, 12A and 12B, as an example of the inventive concept, the current compensator 120 may receive input image data I_DAT corresponding to a third image including a peak white image BPW1_1 of the 1% box. The third image may further include a black image adjacent to the peak white image BPW1_1. The peak white image BPW1_1 may be displayed in a first white area W1_1 having a size corresponding to 1% of the total display area DA, and may be defined as an image displaying white color at the highest grayscale. The black image may be displayed in the remaining areas of the display area DA except for the first white area W1_1, and may be defined as an image displaying a black color at the lowest grayscale. As an example of the inventive concept, the first white area W1_1 may be disposed in the center area of the display panel DP.

The current compensator 120 selects first area load weights corresponding to the first white area W1_1 from the area load weights AL_W, selects first grayscale load weights corresponding to the highest grayscale (e.g., 255 grayscale) from the grayscale load weights GL_W, and selects first to third color load weights corresponding to the first white area W1_1 from the color load weights CL_W. The current compensator 120 may calculate a third load for the third image based on the first area load weights, the first grayscale load weights, and the first to third color load weights. That is, in calculating the third load, efficiency for each area, efficiency for each grayscale, and efficiency for each color may be reflected.

As an example of the inventive concept, the current compensator 120 may receive input image data I_DAT corresponding to a fourth image including a peak white image BPW1_2 of the 1% box. The fourth image may further include a black image adjacent to the peak white image BW1_2. The peak white image BW1_2 may be displayed in a second white area W1_2 having a size corresponding to 1% of the total display area DA, and may be defined as an image displaying white color at the highest grayscale. The black image may be displayed in the remaining areas of the display area DA except for the second white area W1_2, and may be defined as an image displaying a black color at the lowest grayscale. As an example of the inventive concept, the second white area W1_2 may be disposed on the left side based on the center of the display panel DP.

The current compensator 120 selects second area load weights corresponding to the second white area W1_2 from the area load weights AL_W, selects first grayscale load weights corresponding to the highest grayscale (e.g., 255 grayscale) from the grayscale load weights GL_W, and selects first to third color load weights corresponding to the second white area W1_2 from the color load weights CL_W. The current compensator 120 may calculate a fourth load for the fourth image based on the second area load weights, the first grayscale load weights, and the first to third color load weights. That is, in calculating the fourth load, efficiency for each area, efficiency for each grayscale, and efficiency for each color may be reflected.

For example, when the efficiency of the second white area W1_2 is lower than that of the first white area W1_1, when calculating the fourth load for the fourth image, by applying second area load weights higher than the first area load weights, the efficiency for each region may be reflected in the luminance compensation for the fourth image.

In this way, in calculating the load for luminance compensation, by calculating the load as reflecting the load weight for the positional variable, grayscale variable, and color variable, it is possible to accurately compensate for luminance, and as a result, it is possible to improve the overall display quality and have the effect of low power consumption.

According to the inventive concept, by accurately performing luminance compensation in consideration of the difference in efficiency of various variables affecting the load, the overall luminance characteristics of the display device may be improved.

Although the embodiments of the inventive concept have been described, it is understood that the inventive concept should not be limited to these embodiments but various changes and modifications may be made by one ordinary skilled in the art within the spirit and scope of the inventive concept as hereinafter claimed.

What is claimed is:

1. A display device comprising:

a display panel which displays an image;

a current compensator which calculates a load for input image data, compensates the input image data to output compensation image data having a target current corresponding to the load; and a panel driver which drives the display panel based on the compensation image data, wherein the current compensator calculates the load for the input image data based on a combination of load weights calculated by different variables, wherein the input image data includes a plurality of grayscales and a plurality of colors, wherein the load weights include grayscale load weights, and each of the grayscale load weights is calculated based on maximum current data for each grayscale of the grayscales for each color of the colors included in the input image data.

2. The display device of claim 1, wherein the display panel comprises a plurality of measurement areas.

3. The display device of claim 2, wherein the current compensator comprises:

a first weight operation block which calculates the grayscale load weights according to the grayscales expressed by the input image data;

a second weight operation block which calculates area load weights for the plurality of measurement areas;

a third weight operation block which calculates color load weights according to colors included in the input image data; and a data compensation block which calculates the load for the input image data based on the area load weights, the grayscale load weights, and the color load weights, and compensates the input image data to generate the compensation image data having the target current, wherein the combination of the load weights includes the area load weights, the grayscale load weights, and the color load weights.

4. The display device of claim 3, wherein the current compensator further comprises a current extraction block which extracts currents for the grayscales of each measurement area of the measurement areas and outputs extraction data for the grayscales of the measurement areas.

5. The display device of claim 4, wherein the first weight operation block comprises:

a maximum current detection block which detects the maximum current for each grayscale for each color based on the extraction data and outputs the maximum current data for each color for each grayscale; and a first operation block which receives the maximum current data and generates the grayscale load weights based on the maximum current data and target gamma current data based on a target gamma.

6. The display device of claim 5, wherein among the grayscale load weights, a grayscale load weight for a highest grayscale is 1, and grayscale load weights for grayscales other than the highest gray scale are less than 1.

7. The display device of claim 5, wherein the input image data comprises:

first color image data for a first color;

second color image data for a second color; and third color image data for a third color, wherein the grayscale load weights comprise:

first grayscale load weights according to grayscales expressed by the first color image data;

second grayscale load weights according to grayscales expressed by the second color image data; and third grayscale load weights according to grayscales expressed by the third color image data.

8. The display device of claim 5, wherein the maximum current detection block detects a current for a reference grayscale of each measurement area as reference grayscale current data based on the extraction data.

9. The display device of claim 8, wherein the second weight operation block comprises a second operation block which receives from the maximum current detection block the reference grayscale current data and maximum current data of a highest grayscale among the maximum current data, and calculates the area load weights based on the reference grayscale current data and the maximum current data of the highest grayscale.

10. The display device of claim 8, wherein the reference grayscale is the highest grayscale among the grayscales.

11. The display device of claim 8, wherein the third weight operation block comprises a third operation block which calculates the color load weights for colors of each measurement area based on the reference grayscale current data.

12. The display device of claim 11, wherein the input image data comprises:

first color image data for a first color;

second color image data for a second color; and third color image data for a third color, wherein the color load weights comprise:

first color load weights of each measurement area for the first color image data;

second color load weights of each measurement area for the second color image data; and third color load weights of each measurement area for the third color image data.

13. The display device of claim 12, wherein sum of a first color load weight for a corresponding measurement area among the first color load weights, a second color load weight for the corresponding measurement area among the second color load weights, and a third color load weight for the corresponding measurement area among the third color load weights is 1.

14. The display device of claim 3, wherein the data compensation block comprises:

a load operation block which generates the load for the input image data based on the area load weights, the grayscale load weights, and the color load weights; and a current control block which loads a target current according to the load and compensates the input image data to generate the compensation image data corresponding to the target current.

15. The display device of claim 14, wherein the load operation block comprises:

a selection block which selects a corresponding area load weight among the area load weights based on the input image data, selects a corresponding grayscale load weight among the grayscale load weights, and selects a corresponding color load weight among the color load weights; and a fourth operation block which calculates the load based on the corresponding area load weight, the corresponding grayscale load weight, and the corresponding color load weight for the input image data.

16. The display device of claim 15, wherein the load operation block further comprises a storage block in which the grayscale load weights, the area load weights, and the color load weights are stored.

17. A driving method of a display device, the method comprising:

calculating a load for input image data based on a combination of load weights calculated by different variables;

compensating the input image data to have a target current corresponding to the load and outputting compensation image data;

generating a driving signal for driving a display panel based on the compensation image data; and displaying an image on the display panel based on the driving signal, wherein the input image includes a plurality of grayscales and a plurality of colors, wherein the load weights include grayscale load weights, and each of the grayscale load weights is calculated based on maximum current data for each grayscale of the grayscales for each color of the colors included in the input image data.

18. The method of claim 17, wherein the display panel is divided into a plurality of measurement areas, wherein before the calculating of the load, the method further comprises:

calculating the grayscale load weights according to the grayscales expressed by the input image data;

calculating area load weights for the plurality of measurement areas; and calculating color load weights according to colors included in the input image data, wherein the combination of the load weights includes the area load weights, the grayscale load weights, and the color load weights.

19. The method of claim 18, wherein before the calculating of the grayscale load weights, the area load weights, and the color load weights, the method further comprises:

extracting currents for the grayscales of each measurement area, and outputting extraction data for the grayscales of the measurement areas.

20. The method of claim 18, wherein the calculating of the load comprises:

selecting a corresponding area load weight among the area load weights based on the input image data, selecting a corresponding grayscale load weight among the grayscale load weights, and selecting a corresponding color load weight from among the color load weights; and calculating the load based on the corresponding area load weight, the corresponding grayscale load weight, and the corresponding color load weight for the input image data.

* * * * *